US005984704A

United States Patent [19]

Hashiguchi

[11] Patent Number: 5,984,704

[45] Date of Patent: Nov. 16, 1999

[54] ZIF CONNECTOR HAVING MEANS FOR KEEPING FLEXIBLE CONTACT SHEET IN TENSILE CONDITION

[75] Inventor: Osamu Hashiguchi, Akishima, Japan

[73] Assignee: Japan Aviation Electronics Industry, Ltd., Tokyo, Japan

[21] Appl. No.: 09/059,222

[22] Filed: Apr. 13, 1998

[51] Int. Cl.[6] ..... H01R 13/15

[52] U.S. Cl. ..... 439/260; 439/67

[58] Field of Search ..... 439/67, 77, 259, 439/260, 493–499, 629–638

[56] References Cited

U.S. PATENT DOCUMENTS

| | | | |
|---|---|---|---|
| 5,041,003 | 8/1991 | Smith et al. | 439/259 |
| 5,227,959 | 7/1993 | Rubinstein et al. | 439/259 |
| 5,622,505 | 4/1997 | Hashiguchi et al. | 439/67 |
| 5,735,709 | 4/1998 | Hashiguchi et al. | 439/495 |

FOREIGN PATENT DOCUMENTS

| | | |
|---|---|---|
| 3-30273 | 2/1991 | Japan . |
| 3-257775 | 11/1991 | Japan . |
| 4-501338 | 3/1992 | Japan . |

*Primary Examiner*—Khiem Nguyen
*Attorney, Agent, or Firm*—J. Warren Whitesel; Laff, Whitesel & Saret

[57] ABSTRACT

A ZIF connector comprising a combination of first and second connector members attached to first and second objects to be connected, respectively. The first connector member comprises a first housing, a pair of urging plates, a slider, and a pair of flexible contact sheets. The second connector member comprises a second housing and a plurality of contacts. The first housing comprises a support portion having a curved surface for supporting, when the slider slides in the first housing towards the second connector member, an outer surface of the intermediate portion so that the intermediate portion forms a large arc. The urging plate has a pressing portion for pressing an inner surface of the intermediate portion to make the intermediate portion form the large arc in cooperation with the support portion when the urging plate is elastically deflected by the cam portion. The slider has a shoulder portion with a curved surface for supporting the inner surface of the intermediate portion to maintain the large arc formed by the intermediate portion when the slider is located farthest from the first housing.

7 Claims, 20 Drawing Sheets

ZIF CONNECTOR HAVING MEANS FOR KEEPING FLEXIBLE CONTACT SHEET IN TENSILE CONDITION

BACKGROUND OF THE INVENTION

This invention relates to a ZIF (Zero Insertion Force) connector and, in particular, to a ZIF connector comprising, as a set of contact elements, a flexible contact sheet such as an FPC (Flexible Printed Circuit) and an FFC (Flexible Flat Cable).

A ZIF connector using a flexible contact sheet as a set of contact elements is known in the art. For example, ZIF connectors of the type are disclosed in Japanese Unexamined Patent Publications (JP-A) Nos. 3-30273, 3-257775, and 4-501338. However, those ZIF connectors are complicated in structure and therefore difficult to be reduced in size. The operation for connecting or disconnecting two objects (such as printed circuit boards) having such ZIF connectors has at least two step handling motions. In other words, the two objects can not be connected in a single step handling motion and, once connected, can not be disconnected in a single step handling.

In view of the above, an improved ZIF connector is disclosed in Japanese Patent Publication (JP-B) No. 2717393 (see FIGS. 6 through 9). The ZIF connector disclosed in the Japanese patent comprises a combination of first and second connector members mounted to first and second objects, respectively.

The first connector member comprises a first housing, a pair of urging plates, a slider, and a pair of flexible contact sheets. The first housing is adapted to be releasably coupled to the second connector member in a predetermined direction. Each of the urging plates has a jointed portion to which a part of the flexible contact sheet is jointed. The urging plates are attached to the first housing to be elastically deflectable in its thickness direction and to be elastically returned to a predetermined position. The slider is adapted to be fixed on the first object and is attached to the first housing to be relatively slidable in the predetermined direction. The slider has a pair of cam portions to be engaged with the urging plates to elastically deflect the urging plates when the slider slides in the first housing towards the second connector member. Each of the flexible contact sheets comprises an insulator film and a conductor pattern which comprises a plurality of conductor lines as contact elements embedded in the insulator film. The each flexible contact sheet has a supported portion supported by an inner insulator supported in the first housing, an insert portion to be inserted into the second connector member, and a connect portion to be electrically connected to the first object. The conductor pattern is partially exposed in one surface at the insert portion. The insert portion is jointed to the jointed portion of each of the urging plates. The remaining portions of the flexible contact sheet, that is, intermediate portions between the insert portion and the supported portion and between the connect portion and the supported portion, are connected or attached to nothing. Therefore, the remaining portions are movable freely. Therefore, the intermediate portions are collectively referred to as a freely movable sheet portion.

The second connector member comprises a second housing and a plurality of contacts. The second housing is adapted to be attached to the second object and releasably coupled to the first housing in the predetermined direction. Each of the contacts is disposed in the second housing and comprises a terminal portion to be electrically connected to the second object, and a contact portion to face, in a substantially untouched condition, the insert portion positioned by the jointed portion of the urging plate located at the predetermined position when the first and the second housings are coupled to each other and to be brought into contact with the conductor pattern when the urging plate is elastically deflected by the cam portion.

When the first and the second connector members are coupled and released in the predetermined direction, the slider attached to the first object slides with respect to the first housing in the predetermined direction.

With the above-mentioned structure, the freely movable sheet portion of the flexible contact sheet is tightly bent and returned to a relaxed state every time when the first and the second connector members are coupled and released. Thus, the flexible contact sheet is repeatedly bent and relaxed at every coupling and releasing operations of the ZIF connector.

Since the freely movable sheet portion of the flexible contact sheet is repeatedly bent as described above, the freely movable sheet portion tends to be damaged. In particular, the conductor pattern at the freely movable sheet portion is readily damaged.

After the ZIF connector is connected, the freely movable sheet portion of the flexible contact sheet is kept tightly bent. Therefore, the freely movable sheet portion is easily damaged even if the coupling and the releasing operations are not repeated.

Upon connection of the ZIF connector, the first connector member can not be connected to the second connector member if the cam portion of the slider is engaged with the urging plate. However, the ZIF connector has no mechanism for inhibiting the engagement between the cam portion of the slider and the urging plate during connection of the ZIF connector. Furthermore, no mechanism is provided to maintain the first and the second connector members in a connected state after the ZIF connector is connected. Therefore, the first connector member may not be smoothly connected to the second connector member upon connecting of the ZIF connector. After the first connector member is connected to the second connector member, the first connector member may easily be released from the second connector member when subjected to external force.

In the ZIF connector, the flexible contact sheet is positioned with respect to the first housing simply by inserting the inner insulator into a gap between the first housing and the slider. Therefore, the flexible contact sheet is easily dislocated. If the ZIF connector is reduced in size, the flexible contact sheet may possibly be brought into false contact with the contacts of the second connector member.

SUMMARY OF THE INVENTION

It is therefore a first object of this invention to provide a ZIF connector which is capable of avoiding a freely movable sheet portion of a flexible contact sheet from being readily damaged.

It is a second object of this invention to provide a ZIF connector which is capable of establishing smooth connection and reliably keeping the established connection.

It is a third object of this invention to provide a ZIF connector which is capable of reliably fixing a flexible contact sheet.

According to this invention, there is provided a ZIF connector comprising a combination of first and second connector members attached to first and second objects to be connected, respectively. The first connector member comprises a first housing, an urging plate, a slider, and a flexible contact sheet. The first housing is adapted to be releasably coupled to the second connector member in a predetermined direction. The urging plate has a jointed portion to which a part of the flexible contact sheet is jointed. The urging plate is attached to the first housing to be elastically deflectable in its thickness direction and to be elastically returned to a predetermined position. The slider is adapted to be mounted on the first object and is attached to the first housing to be relatively slidable in the predetermined direction. The slider has a cam portion to be engaged with the urging plate to elastically deflect the urging plate when the slider slides in the first housing towards the second connector member. The flexible contact sheet comprises an insulator film and a conductor pattern embedded in the insulator film. The flexible contact sheet has an insert portion to be inserted into the second connector member and jointed to the jointed portion of the urging plate, the conductor pattern being exposed on one surface at the insert portion, a connect portion to be electrically connected to the first object, and an intermediate portion between the insert and the connect portions. The second connector member comprises a second housing and a plurality of contacts. The second housing is adapted to be attached to the second object and releasably coupled to the first housing in the predetermined direction. The contacts are disposed in the second housing and comprise terminal portions to be electrically connected to the second object, and contact portions to face, in a substantially untouched condition, the insert portion positioned by the jointed portion of the urging plate located at the predetermined position when the first and the second housings are coupled to each other and to be brought into contact with the conductor pattern when the urging plate is elastically deflected by the cam portion. The first housing further comprises a support portion having a curved surface for supporting, when the slider slides in the first housing towards the second connector member, an outer surface of the intermediate portion so that the intermediate portion forms a large arc. The urging plate has a pressing portion for pressing an inner surface of the intermediate portion to make the intermediate portion form the large arc in cooperation with the support portion when the urging plate is elastically deflected by the cam portion. The slider has a shoulder portion with a curved surface for supporting the inner surface of the intermediate portion to maintain the large arc formed by the intermediate portion when the slider is located farthest from the first housing.

Preferably, the flexible contact sheet has a ground pattern formed on the other surface. The urging plate serves as a first ground contact electrically connected to the ground pattern. The second housing includes a second ground contact to be brought into electrical contact with the first ground contact.

Preferably, the ZIF connector further comprises a first locking mechanism formed on the first housing and the slider for locking the slider to the first housing at a position such that the cam portion is not engaged with the urging plate, an unlocking mechanism formed on the second housing for unlocking the first housing and the slider locked by the first locking mechanism when the first and the second housings are coupled to each other; and a second locking mechanism formed on the first housing, the slider, and the second housing for locking the first and the second housings to each other when the slider slides towards the second connector member while the first and the second housings are coupled to each other, for finally locking the slider to the first housing and maintaining the first and the second housings in a locked state, and for unlocking the slider from the first housing locked by the second locking mechanism by the movement of the slider away from the second connector member.

Preferably, the first locking mechanism comprises a pair of first lock springs formed on both sides of the slider to extend in the predetermined direction, and a pair of step portions formed on both sides of the first housing to receive one ends of the first lock springs, respectively. The unlocking mechanism comprises a pair of side wall portions formed on both sides of the second housing and having cam surfaces for engaging the one ends of the first lock springs to displace the one ends so that the first lock springs are released from engagement with the step portions. The second locking mechanism comprises a pair of second lock springs formed on the both sides of the first housing to extend in the predetermined direction and having one ends provided with locking protrusions and cam protrusions formed on one and the other surfaces thereof, a pair of locking recesses formed on the both sides of the second housing to be engaged with the locking protrusions, and a pair of pressing pieces formed on the both sides of the slider to extend in the predetermined direction and having press protrusions formed at one ends thereof to press the cam protrusions and to be locked to edges of the cam protrusions.

Preferably, the slider has a retainer attached thereto. The retainer has a holding portion for elastically pressing the flexible contact sheet against the slider in its thickness direction to fix the flexible contact sheet to the slider.

Preferably, the slider has a slider protrusion formed on its one surface faced to the retainer to extend in the predetermined direction. The flexible contact sheet has a hole for inserting the slider protrusion to automatically position the flexible contact sheet with respect to the slider.

Preferably, the slider protrusion has a groove extending in the predetermined direction. The holding portion has a notch for inserting the slider protrusion. The notch has a holding protrusion formed on an inner surface thereof to be engaged with the groove to prevent deformation of the holding portion.

DESCRIPTION OF THE PREFERRED EMBODIMENTS

In order to facilitate an understanding of this invention, description will at first be made about a conventional ZIF connector.

Figure 1:
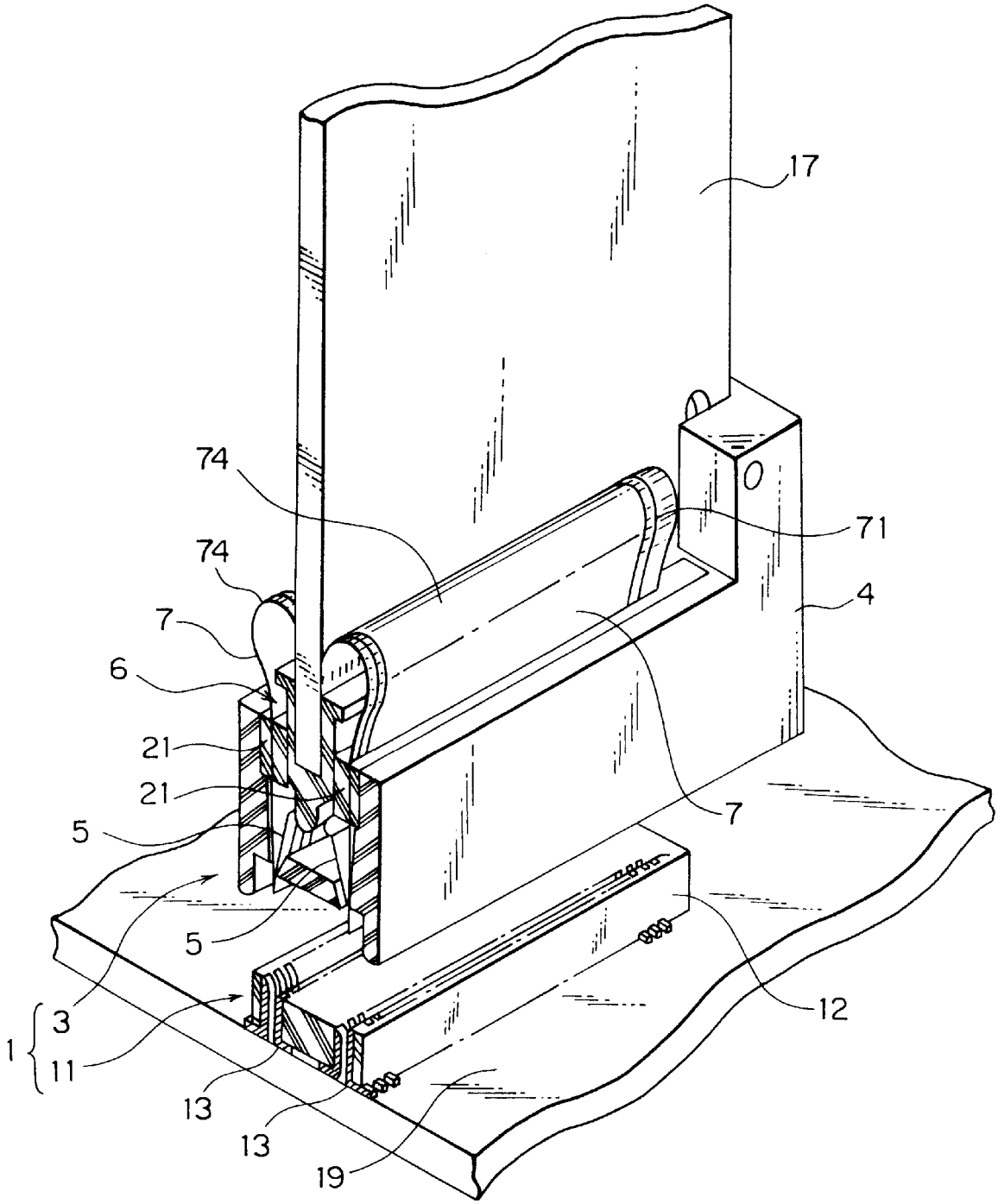
FIG. 1 PRIOR ART
FIG. 1 is a perspective view of a conventional ZIF connector with one side cut away.
Figure 2:
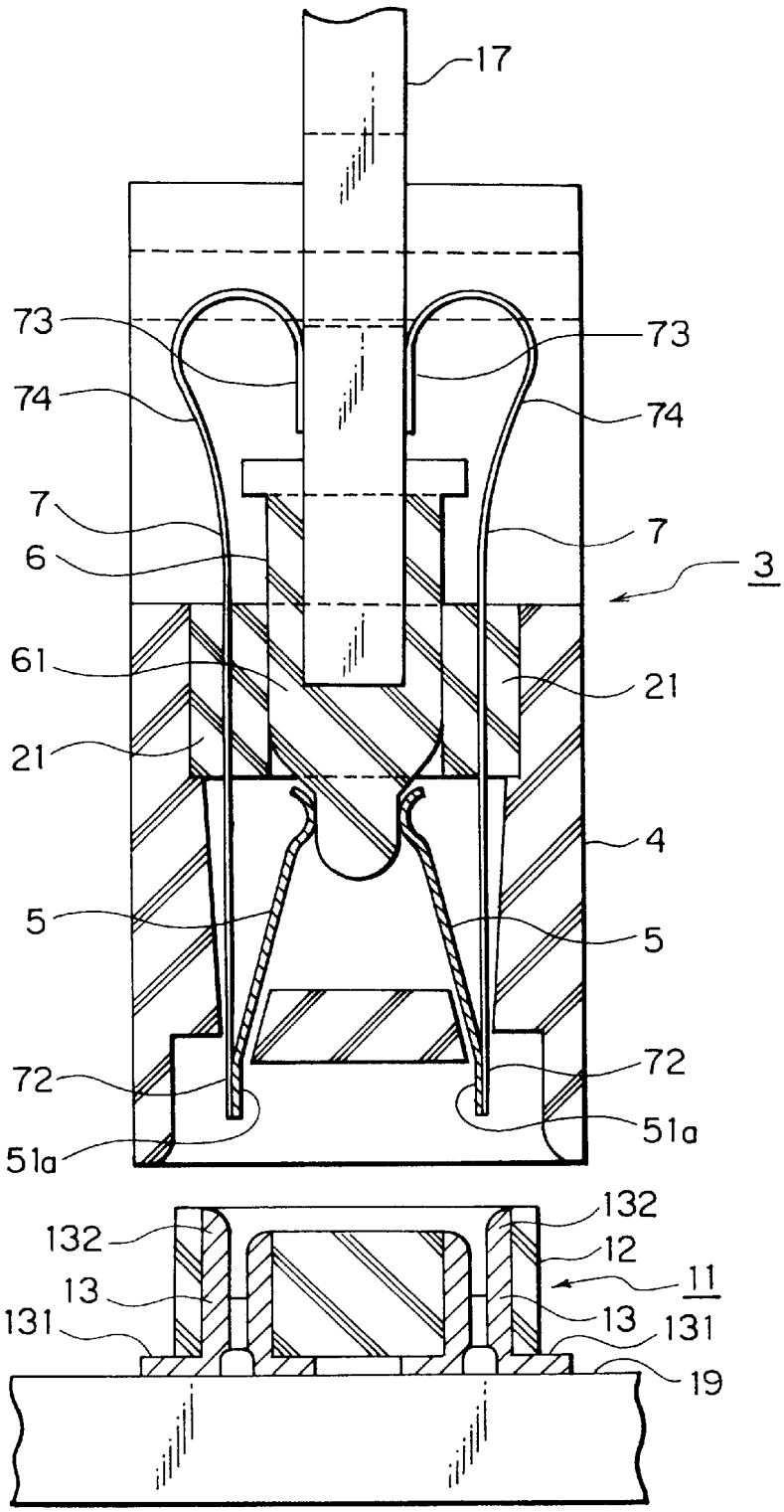
FIG. 2 PRIOR ART
FIG. 2 is a vertical sectional view of the ZIF connector illustrated in FIG. 1 in an uncoupled state.
Figure 3:
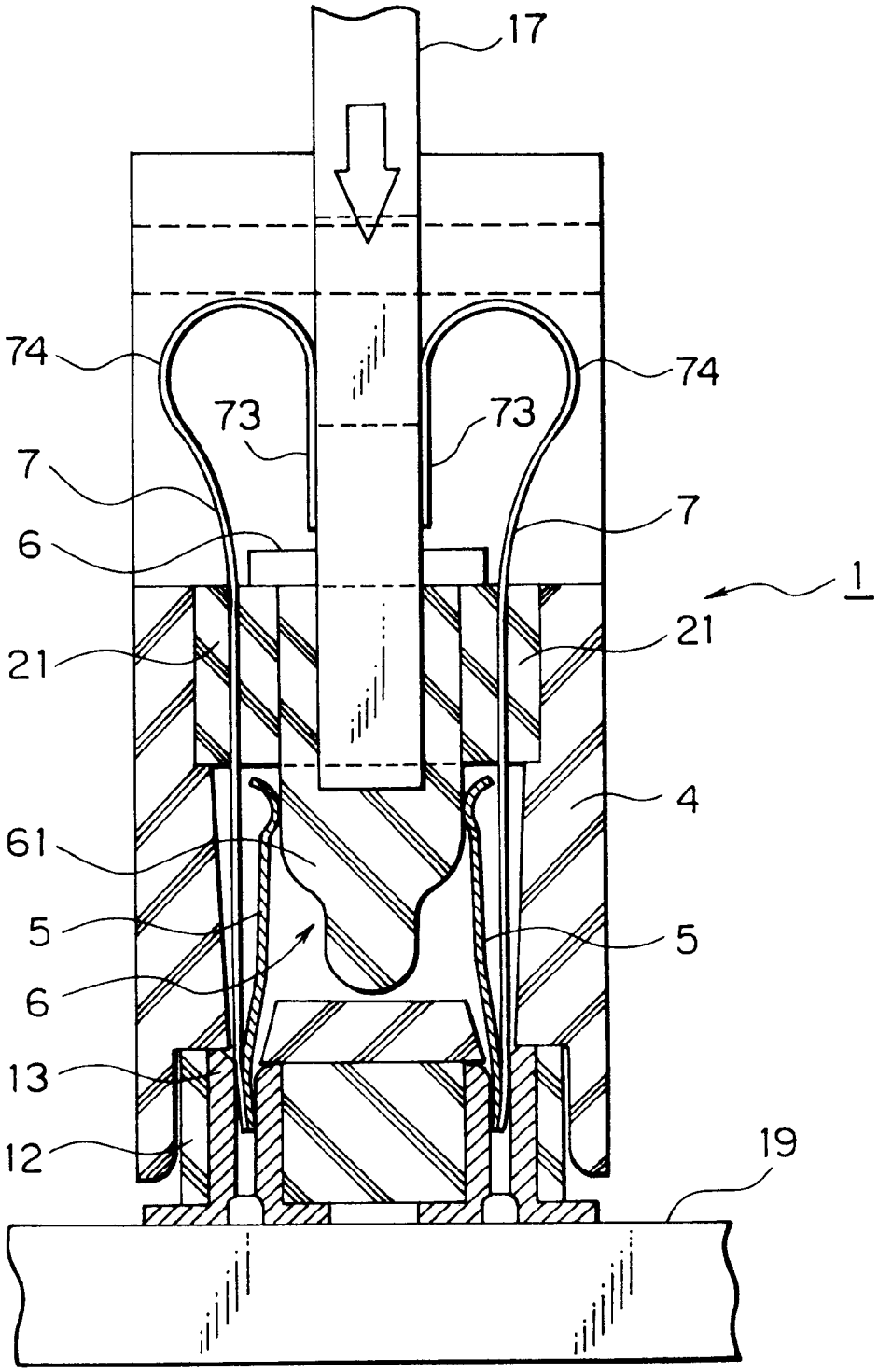
FIG. 3 PRIOR ART
FIG. 3 is a vertical sectional view of the ZIF connector illustrated in FIG. 1 in a coupled state.

Referring to FIGS. 1 through 3, the ZIF connector 1 comprises a combination of a first connector member 3 and a second connector member 11 attached to a first object 17 and a second object 19 to be connected, respectively.

The first connector member 3 comprises a first housing 4, a pair of urging plates 5, a slider 6, and a pair of flexible contact sheets 7.

The first housing 4 is adapted to be releasably coupled to the second connector member 11 in a predetermined direction.

Each of the urging plates 5 has a jointed portion 51*a* to which a part of the flexible contact sheet 7 is jointed. Each urging plate 5 is disposed in the first housing 4 to be elastically deflectable in its thickness direction and to be elastically returned to a predetermined position.

The slider 6 is adapted to be fixed on the first object 17 and is attached to the first housing 4 to be relatively slidable in the above-mentioned predetermined direction. The slider 6 has a pair of cam portions 61 to be engaged with the urging plates 5 to elastically deflect the urging plates 5 when the slider 6 slides in the first housing 4 towards the second connector member.

Each of the flexible contact sheets 7 comprises an insulator film and a conductor pattern 71 which comprises a plurality of conductor lines as contact elements embedded in the insulator film. The each flexible contact sheet 7 has a supported portion supported by an inner insulator 21 supported in the first housing 4, an insert portion 72 to be inserted into the second connector member 11, and a connect portion 73 to be electrically connected to the first object 17. The conductor pattern 71 is partially exposed in one surface at the insert portion 72. The insert portion 72 is jointed to the jointed portion 51*a* of each of the urging plates 5. The remaining portions of the flexible contact sheet 7, that is, intermediate portions 74 between the insert portion and the supported portion and between the connect portion and the supported portion, are connected or attached to nothing. Therefore, the remaining portions are movable freely. Therefore, the intermediate portions 74 are collectively referred to as a freely movable sheet portion.

The second connector member 11 comprises a second housing 12 and a plurality of contacts 13.

The second housing 12 is to be attached to the second object 19 and releasably coupled to the first housing 4 in the predetermined direction.

Each of the contacts 13 is disposed in the second housing 12 and comprises a terminal portion 131 to be electrically connected to the second object 19, and a contact portion 132 to face, in a substantially untouched condition, the insert portion 72 positioned by the jointed portion 51*a* of the urging plate 5 located at the predetermined position when the first and the second housings 4 and 12 are coupled to each other and to be brought into contact with the conductor pattern 71 when the urging plate 5 is elastically deflected by the cam portion 61.

Upon connection of the ZIF connector 1, the first connector member 3 can not be connected to the second connector member 11 if the cam portion 61 of the slider 6 is engaged with the urging plate 5. However, the ZIF connector 1 has no mechanism for inhibiting the engagement between the cam portion 61 of the slider 6 and the urging plate 5 during connection of the ZIF connector 1. Furthermore, no mechanism is provided to maintain the first and the second connector members 3 and 11 in a connected state after the ZIF connector 1 is connected.

In the ZIF connector 1, the flexible contact sheet 7 is positioned with respect to the first housing 4 simply by inserting the inner insulator 21 attached to its vertical intermediate portion into a gap between the first housing 4 and the slider 6.

The above-mentioned disadvantages are caused because the ZIF connector 1 does not have a portion for supporting the freely movable sheet portion of the flexible contact sheet 7, a mechanism for locking the slider 6 upon connection of the ZIF connector 1, a mechanism for locking each component of the ZIF connector 1 after connection of the ZIF connector, and a member for reliably fixing the flexible contact sheet 7 to the slider 6.

Next referring to FIGS. 4 through 21, a ZIF connector according to one embodiment of this invention will be described. Various directions recited in the following description are based on an orientation of the ZIF connector illustrated in FIG. 4.

The ZIF connector 1 according to the embodiment comprises a combination of a first connector member 3 and a second connector member 11 (FIGS. 4 and 5) attached to a first printed board 17 (FIG. 20) as a first object and a second printed board 19 (FIG. 21) as a second object, respectively.

Figure 6:
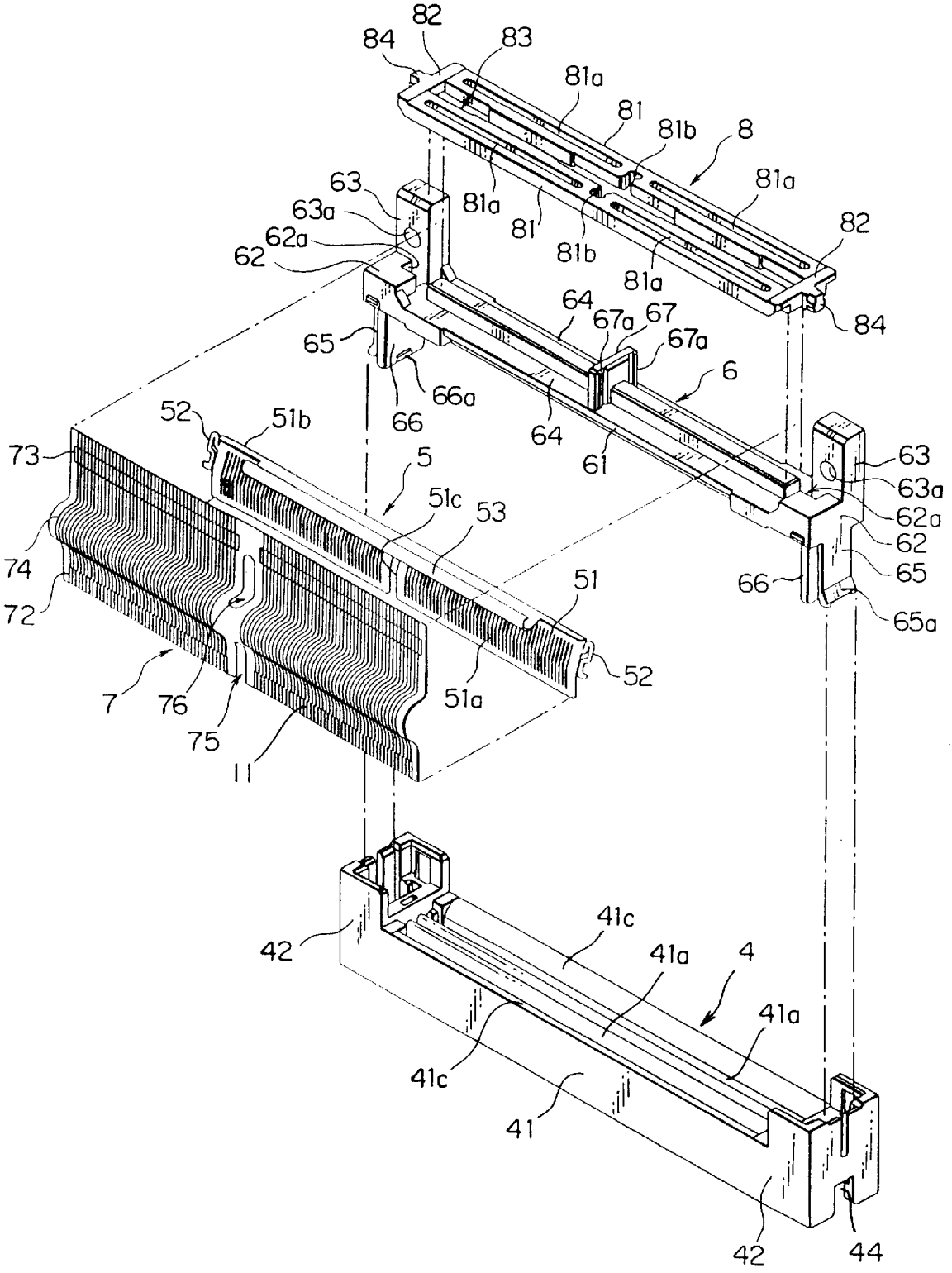
FIG. 6 is an exploded perspective view of a first connector member illustrated in FIG. 4.
Figure 7C:
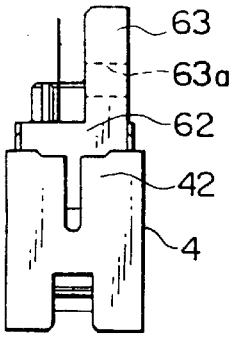
FIGS. 7A through 7D show the first connector member illustrated in FIG. 4 in a plan view, a front view, a side view, and a bottom view, respectively.
Figure 7A:
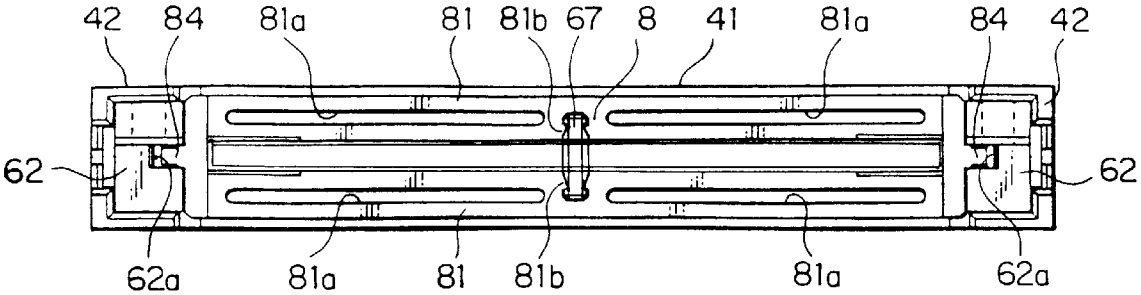
Figure 7B:
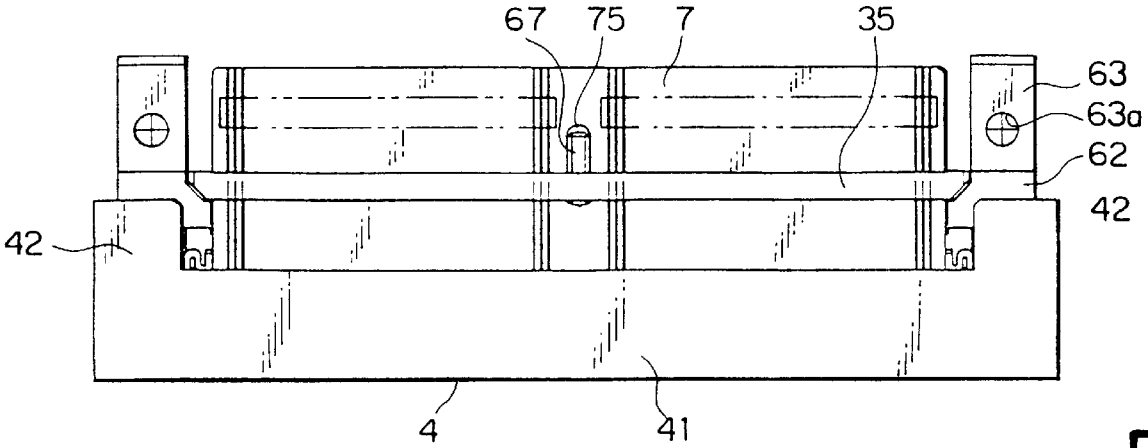
Figure 7D:
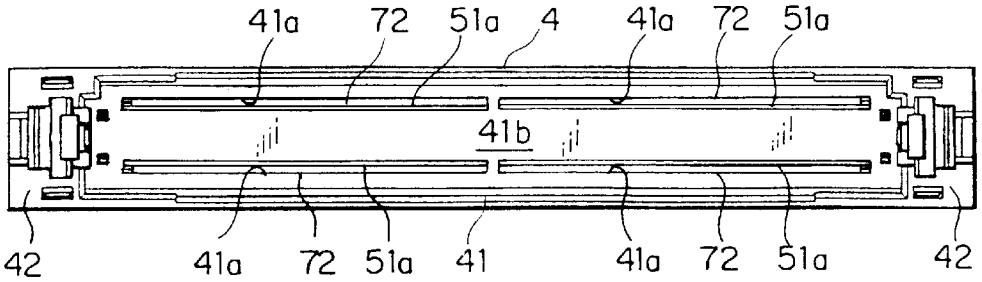
Figure 8:
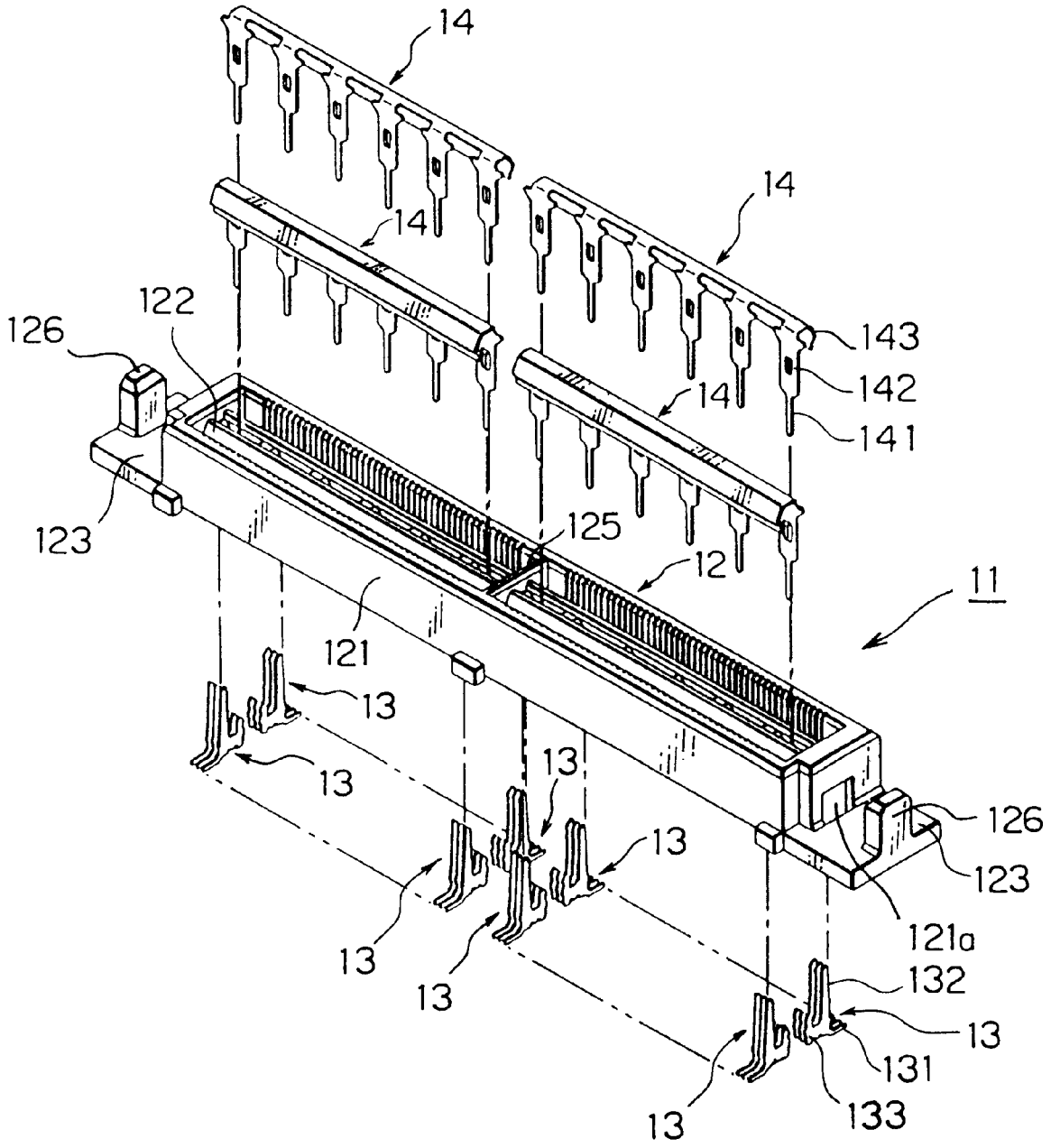
FIG. 8 is an exploded perspective view of a second connector member illustrated in FIG. 4.
Figure 9C:
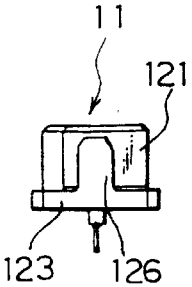
FIGS. 9A through 9D show the second connector member illustrated in FIG. 4 in a plan view, a front view, a side view, and a bottom view, respectively.
Figure 9A:
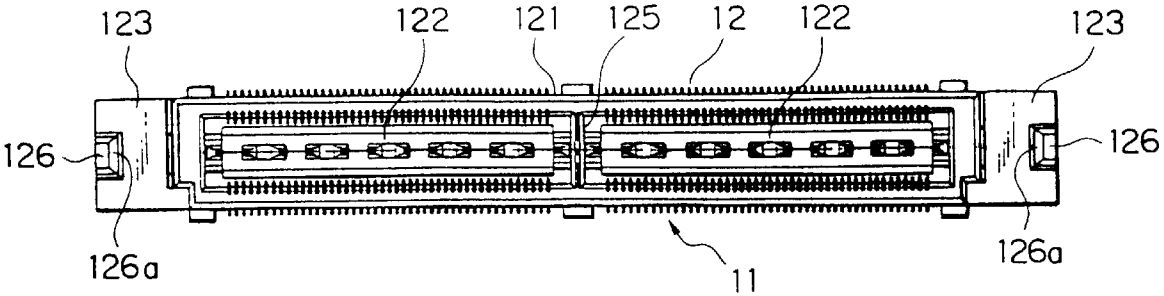
Figure 9B:
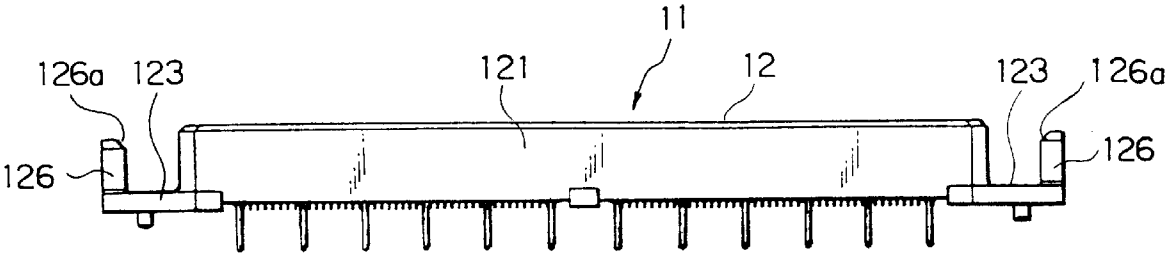
Figure 9D:
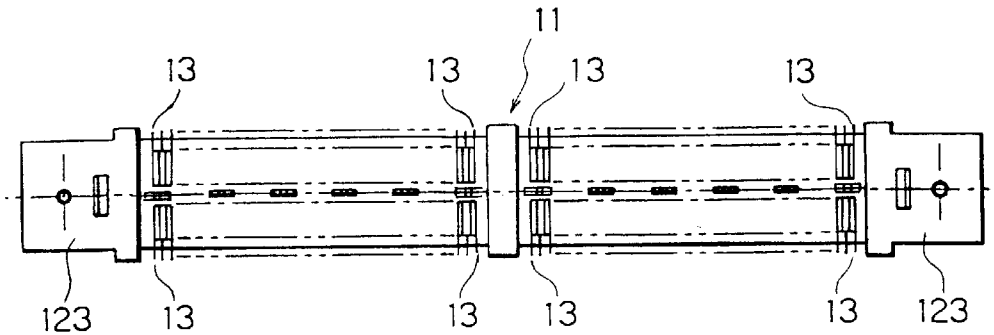

The first connector member 3 comprises a first housing 4, a pair of urging plates 5, a slider 6, and a pair of FPCs 7 as flexible contact sheets (FIGS. 6 and 7).

Figure 4:
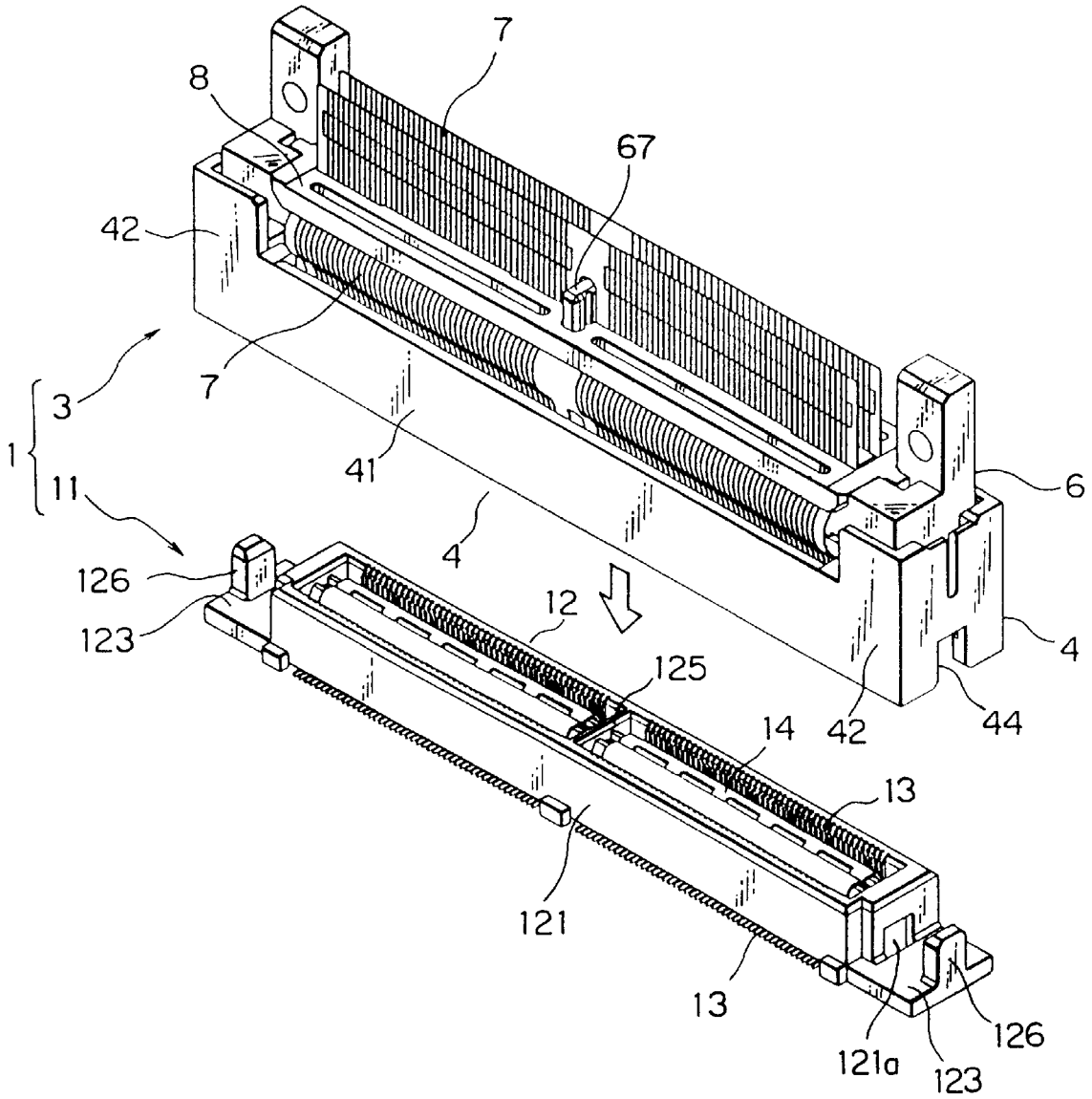
FIG. 4 is a perspective view of a ZIF connector according to a first embodiment of this invention in an uncoupled state.
Figure 5:
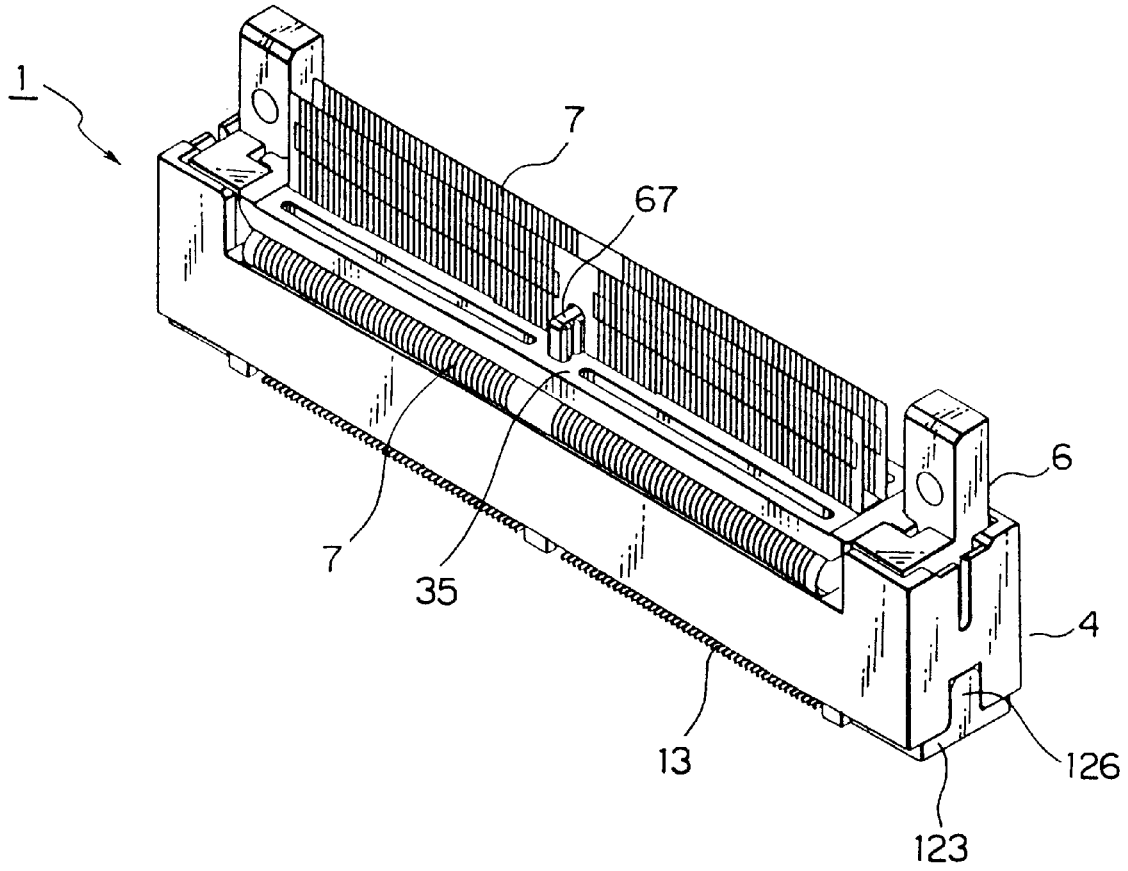
FIG. 5 is a perspective view of the ZIF connector illustrated in FIG. 4 in a coupled state.
Figure 10:
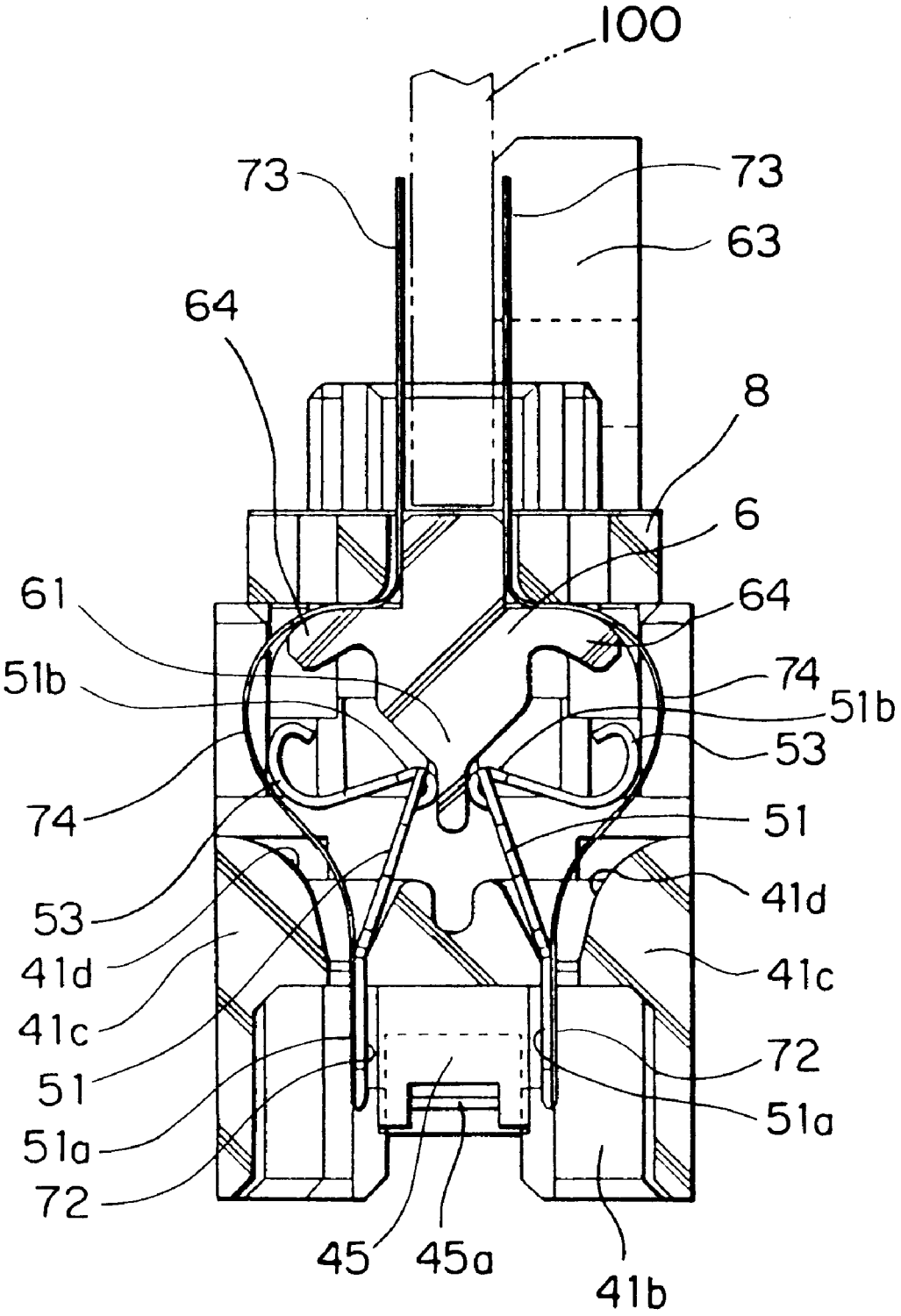
FIG. 10 is a vertical sectional view of the first connector member illustrated in FIG. 4 in an uncoupled state.
Figure 11:
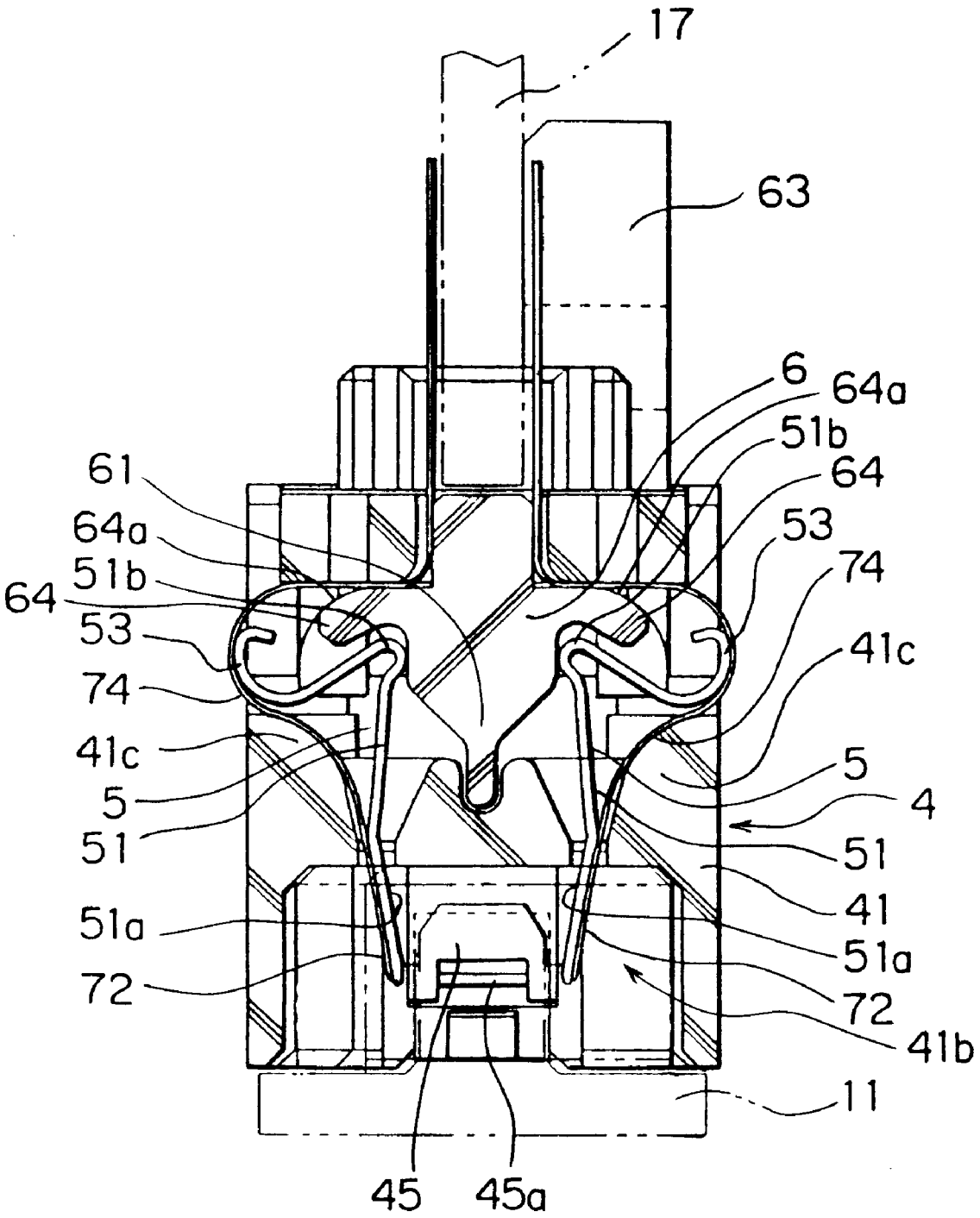
FIG. 11 is a vertical sectional view of the first connector member illustrated in FIG. 4 in a coupled state.
Figure 12:
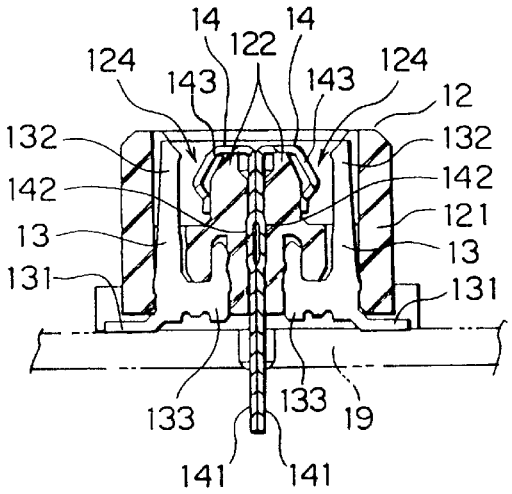
FIG. 12 is a vertical sectional view of the second connector member illustrated in FIG. 4.

The first housing 4 is adapted to be releasably coupled to the second connector member 11 in a predetermined direction (vertical direction in FIG. 4). The first housing 4 comprises a housing body 41 in the form of an elongated box, and a pair of slider holding portions 42 integrally formed on longitudinal opposite ends of the housing body 41. The housing body 41 has a pair of grooves 41*a* formed in its upper part to extend in a longitudinal direction. The grooves 41*a* serve to receive the FPCs 7 inserted therethrough. The housing body 41 has a lower part serving as a receiving portion 41*b* for receiving the second connector member 11 (FIGS. 10 and 11). The slider holding portions 42 are for holding the slider 6 so that the slider 6 is slidable in the predetermined direction. Each of the slider holding portions 42 has an insert hole 42*a* (FIG. 14) for insertion of a first lock spring 65 and a pressing piece 66 of the slider 6 which will later be described.

Each of the urging plates 5 is made of an elastic conductive metal plate and is attached to the first housing 4 with its lower portion inserted in the first housing 4. The urging plate 5 comprises an urging plate body 51 and a pair of fixed portions 52 integral therewith (FIG. 6). The urging plate body 51 has a lower part gently bent to form a jointed portion 51*a*. To the jointed portion 51*a*, an insert portion 72 of the FPC 7 which will later be described is jointed. With the insert portion 72 thus jointed, the jointed portion 51*a* presses the insert portion 72 towards contact portions 132 of contacts 13 which will later be described. The urging plate 51 has a rounded upper end which serves as an engaging portion 51*b* (FIGS. 10 and 11). The engaging portion 51*b* is engaged with a cam portion 61 of the slider 6, which will later be described, when the first and the second connector members 3 and 11 are coupled and released. Furthermore, the urging plate body 51 has a notch 51*c* formed at its center to receive a partition 125 formed in the seconding housing 12 which will later be described. On the other hand, the fixed portions 52 are formed on longitudinal opposite ends of the urging plate body 51. By fixing the fixed portions 52 to the first housing 4, the urging plate 5 is attached to the first housing 4 to be elastically deflectable in its thickness direction and to be elastically returned to a predetermined position.

The slider 6 is adapted to be fixed on the first printed board 17 and is attached to the first housing 4 to be relatively slidable in the predetermined direction. The slider 6 comprises the cam portion 61, a pair of insert portions 62, and a pair of fixed portions 63 integrally formed. The cam portion 61 has a rod-like shape and is engaged with the engaging portion 51*b* of the urging plate 5 to elastically deflect the urging plate 5 when the slider 6 slides in the first housing 4 towards the second connector member 11 (FIGS. 10 and 11). The insert portions 62 have a block-like shape and formed on longitudinal opposite ends of the cam portion 61. Each of the insert portions 62 has a groove 62*a* (FIG. 7) formed at the side of the cam portion 61 to receive a retainer protrusion 84 of a retainer 8 which will later be described. The insert portions 62 are slidably inserted in the slider holding portions 42 of the first housing 4. By slidably inserting the insert portions 62 in the slider holding portions 42, the slider 6 is attached to the first housing 4 to be relatively slidable in the predetermined direction. The fixed portions 63 are formed on upper surfaces of the insert portions 62. The fixed portions 63 serve to fix the slider 6 to the first printed board 17 and are provided with bolt holes 63*a*.

In this embodiment, the FPCs 7 are used as the flexible contact sheets as described above. Each of the FPCs 7 is of a typical one which comprises a flexible insulator plate and a conductor pattern 71. A ground pattern (not shown) formed on the other surface of the flexible insulator plate. The conductor pattern 71 is covered with a transparent insulating sheet (not shown) except at the lower end of the FPC 7. In other words, the conductor pattern 71 is exposed at the lower end of the FPC 7. The FPC 7 has an insert portion 72, a connect portion 73, and an intermediate portion 74 between the insert portion 72 and the connect portion 73 (FIG. 6). The insert portion 72 is formed at the lower end of the FPC 7 and is inserted into the housing body 41 of the first housing 4 through the groove 41*a*. The insert portion 72 is inserted into the second connector member 11 for electrically connection with the second connector member 11. The insert portion 72 is jointed at the other surface to the jointed portion 51*a* of the urging plate 5. As described above, the ground pattern is exposed on the other surface of the insert portion 72. Therefore, the urging plate 5 is electrically connected to the ground pattern of the FPC 7 through the jointed portion 51*a*. Thus, the urging plate 5 serves as a first ground contact in this embodiment. The connect portion 73 is formed at a top end of the FPC 7 to be electrically connected to pads 171 (FIG. 20) formed on the first printed board 17. The intermediate portion 74 extends between the insert portion 72 and the connect portion 73 and is required to be freely movable so as to allow sliding of the slider 6 moving together with the first printed board 17. The FPC 7 has a notch 75 and an elongated hole 76 formed in its center region at lower and upper positions, respectively. The notch 75 is for receiving the partition 125 of the second housing 12 which will later be described. The elongated hole 76 is for inserting a slider protrusion 67 of the slider 6 which will later be described.

The second connector member 11 comprises the second housing 12, a plurality of the contacts 13, and a plurality of second ground contacts 14 (FIGS. 8, 9A–9D, 12).

The second housing 12 is adapted to be fixed on the second printed board 19 and comprises a housing body 121, a contact press-fit portion 122, and a pair of bottom plate portions 123 integrally formed. The housing body 121 is in the form of an elongated box. The contact press-fit portion 122 is formed in the housing body 121. A receiving space 124 is defined between the contact press-fit portion 122 and the housing body 121. The receiving space 124 is for receiving the insert portion 72 of the FPC 7 and the jointed portion 51*a* of the urging plate 5. The housing body 121 has the partition 125 in order to divide the receiving space 124 into two parts in its longitudinal direction. The bottom plate portions 123 are formed on bottom surfaces of the housing body 121 at its longitudinal opposite ends. The second housing 12 is fixed on the second printed board 19 through the bottom plate portions 123.

Each of the contacts 13 comprises a terminal portion 131, a contact portion 132, and a press-fit portion 133 integrally formed. The terminal portion 131 is adapted to be electrically connected to a pad 191 (FIG. 21) of the second printed board 19. The contact portion 132 extends from the upper end of the terminal portion 131 and protrudes into the receiving space 124 when the press-fit portion 133 is press-fitted into the contact press-fit portion 122 of the second housing 12. The contact portion 132 protruding into the receiving space 124 faces, in a substantially untouched condition, the insert portion 72 of the FPC 7 positioned by the jointed portion 51*a* of the urging plate 5 located at the predetermined position when the first and the second housings 4 and 12 are coupled to each other. Thereafter, when the urging plate 5 is pressed by the cam portion 61 of the slider 6 to elastically deflect, the contact portion 132 is brought into contact with the conductor pattern 71 exposed on the one surface of the insert portion 72 of the FPC 7 to be electrically connected to the conductor pattern 71. The press-fit portion 133 extends from one side of the contact portion 132 to be press-fitted into the contact press-fit portion 122 of the second housing 12.

Each of the second ground contacts 14 comprises a terminal portion 141, a press-fit portion 142, and a contact portion 143. The terminal portion 141 is inserted into a through hole 192 of the second printed board 19 (FIG. 21) to be electrically connected thereto. The press-fit portion 142 extends from an upper end of the terminal portion 141 to be press-fitted into the contact press-fit portion 122. When the press-fit portion 122 is fitted into the contact press-fit portion 122, the contact portion 143 covers one side of an upper end of the contact press-fit portion 122, is located in the receiving space 124, and faces the contact portion 132 of the contact 13. In this state, like the contact portion 132, the contact portion 143 faces, in a substantially untouched condition, the jointed portion 51*a* of the urging plate 5 located at the predetermined position when the first and the second housing 4 and 12 are coupled to each other. Thereafter, when the urging plate 5 is pressed by the cam portion 61 of the slider 6 to elastically deflect, the contact portion 143 is brought into contact with the jointed portion 51*a* of the urging plate 5 to be electrically connected to the ground pattern of the FPC 7 through the jointed portion 51*a*.

Figure 13:
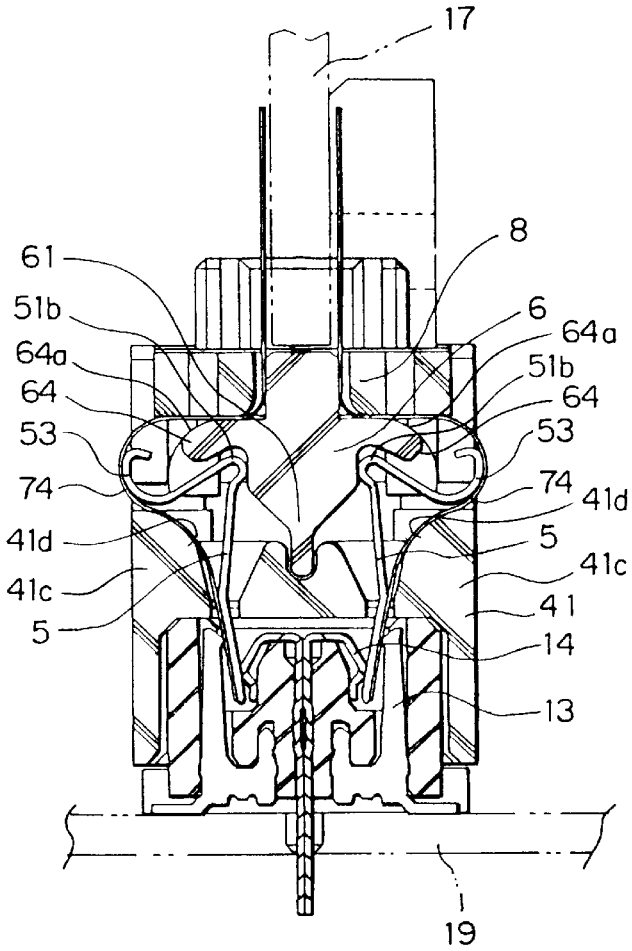
FIG. 13 is a vertical sectional view of the ZIF connector illustrated in FIG. 4 in a coupled state.

The housing body 41 of the first housing 4 has a pair of side walls extending in the longitudinal direction to serve as support portions 41*c* for supporting the FPC 7 (FIGS. 10, 11, and 13). Each of the support portions 41*c* has a curved surface 41*d* for supporting an outer surface of the intermediate portion 74 so that the intermediate portion 74 forms a large arc when the slider 6 slides towards the second connector member 11. It will be understood that the intermediate portion 74 of the FPC 7 supported by the support portion 41*c* forms the arc greater in curvature than that formed by the intermediate portion 74 in absence of the support portion 41*c*. That is, the intermediate portion 74 of the FPC 7 is kept in the tensile condition with an arc shape forced by the support portion 41*c*.

The engaging portion 51*b* of the urging plate 5 has a pressing portion 53 formed at its top end. When the urging plate 5 is elastically deflected by the cam portion 61 of the slider 6, the pressing portion 53 presses an inner surface of the intermediate portion 74 to increase the curvature of the arc formed by the intermediate portion 74 of the FPC 7 in cooperation with the support portion 41*c* of the first housing 4. Thus, the intermediate portion 74 is also kept in the tensile condition with the arc shape forced by the pressing portion 53. The pressing portion 53 has a rounded upper end for pressing the FPC 7.

The slider 6 has a pair of shoulder portions 64 formed on both sides of the cam portion 61. As illustrated in FIG. 10, each of the shoulder portions 64 supports the intermediate portion 74 to keep a greater curvature of the arc formed by the intermediate portion 74 of the FPC 7 when the slider 6 is located at a farthest position from the first housing 4. Each of the shoulder portions 64 has a curved surface 64*a* for supporting the inner surface of the intermediate portion 74.

In addition to the basic structure described above, the ZIF connector 1 further comprises a first locking mechanism, an unlocking mechanism, and a second locking mechanism. These mechanisms serve to help smooth connection between the first and the second connector members 3 and 11 and, after completion of the connection, to reliably keep the connection.

The first locking mechanism is formed on the first housing 4 and the slider 6 to lock the slider 6 to the first housing 4 at a position such that the cam portion 61 of the slider 6 is not engaged with the engaging portion 51*b* of the urging plate 5.

The unlocking mechanism is formed on the second housing 12 to unlock the first housing 4 and the slider 6 locked by the first locking mechanism when the first and the second housings 12 are coupled to each other.

The second locking mechanism is formed on the first housing 4, the slider 6, and the second housing 12. The second locking mechanism serves to lock the first and the second housings 4 and 12 to each other when the slider 6 slides towards the second connector member 11 while the first and the second housings 4 and 12 are coupled to each other, to finally lock the slider 6 to the first housing 4 and keep the first and the second housings 4 and 12 in a locked state, and to unlock the slider 6 from the first housing 4 by the movement of the slider 6 away from the second connector member 11.

Figure 14:
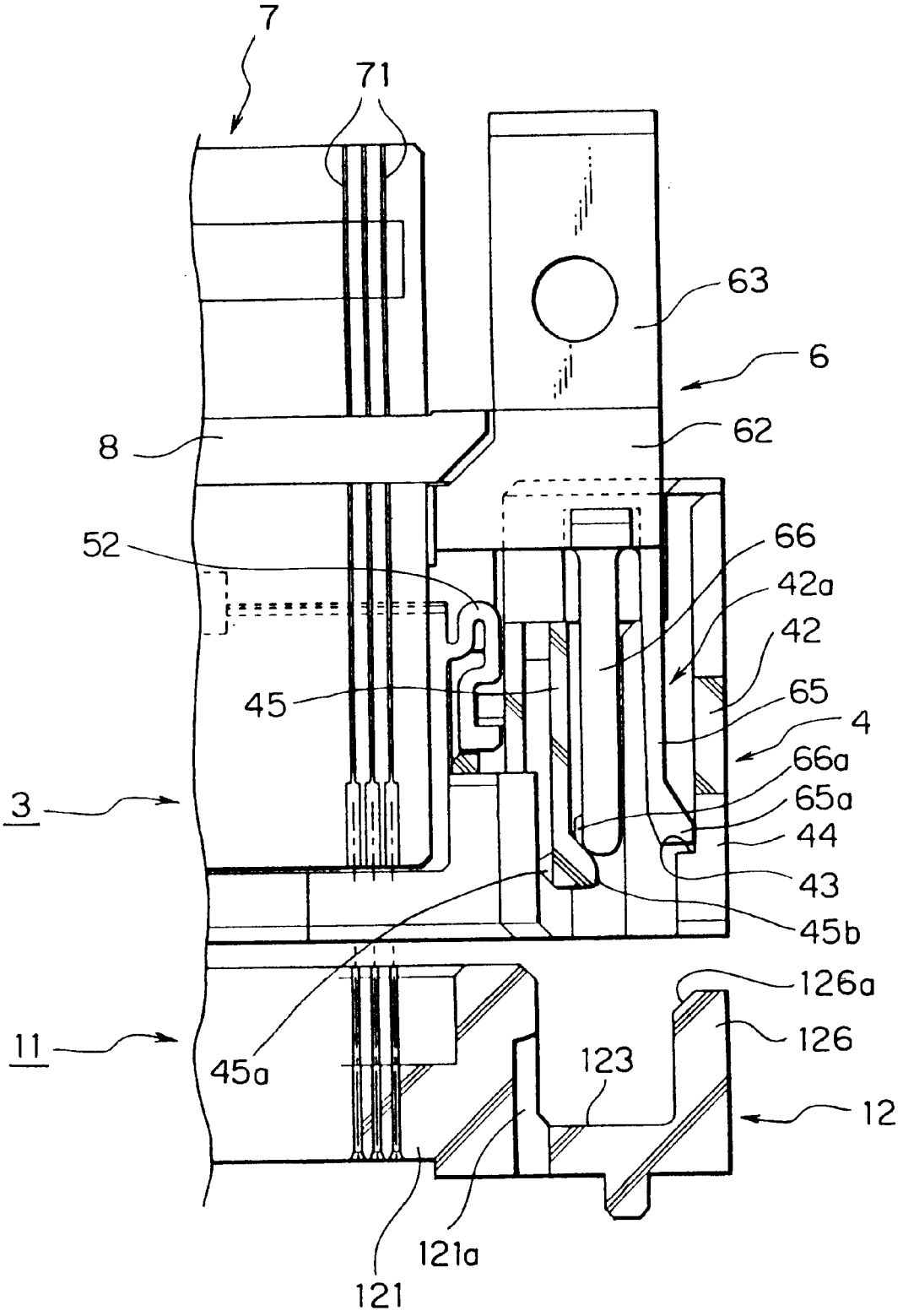
FIG. 14 is an enlarged sectional view of a main portion of the ZIF connector in FIG. 4 in the uncoupled state.
Figure 15:
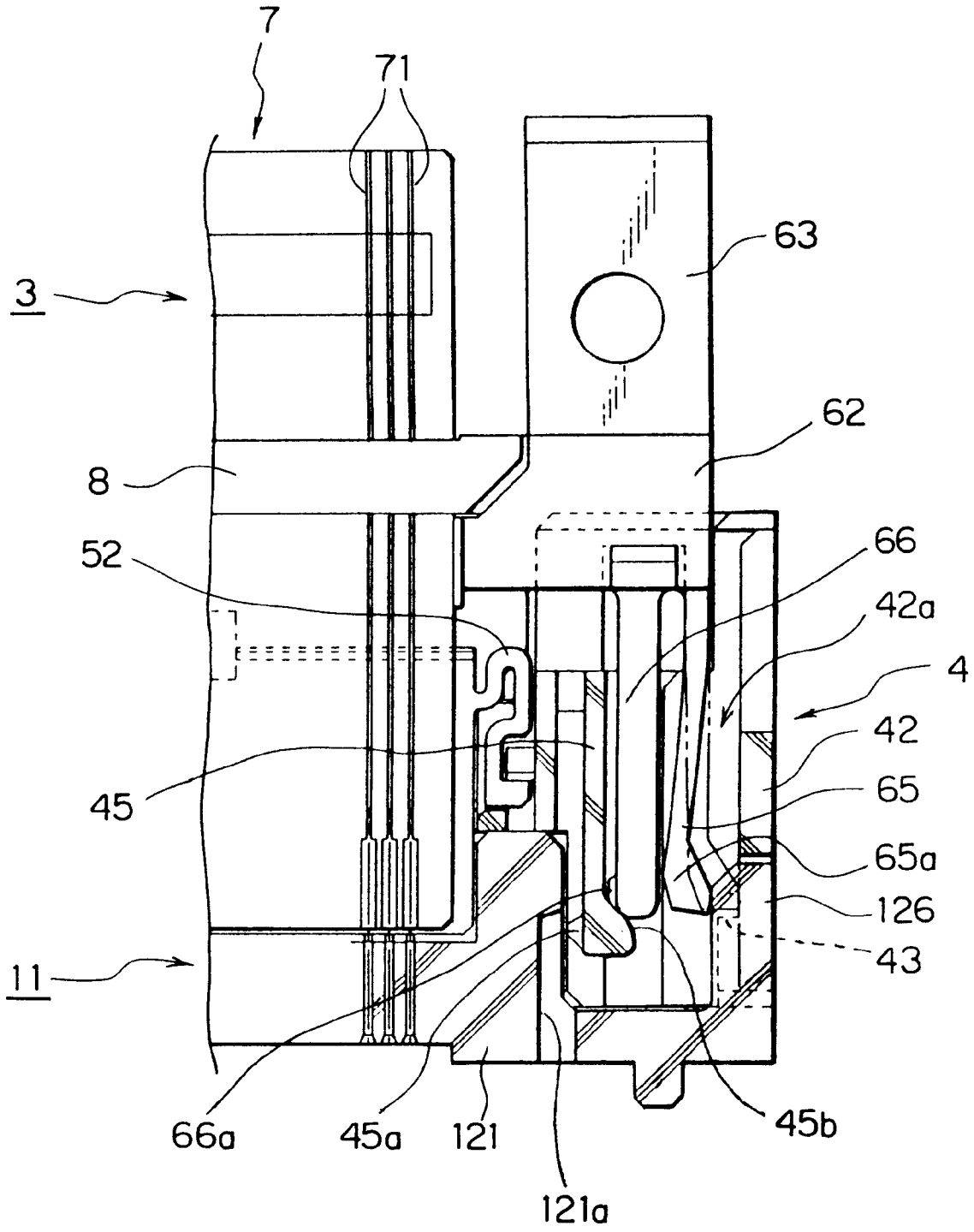
FIG. 15 is an enlarged sectional view for describing an operation of the ZIF connector illustrated in FIG. 4.

In this embodiment, the first locking mechanism comprises a first lock spring 65 and a pair of step portions 43, as illustrated in FIG. 14. The first lock spring 65 is formed on an outer edge of the lower surface of the slider insert portion 62 formed on each side of the slider 6 to extend in the predetermined direction. The first lock spring 65 is provided with a spring protrusion 65*a* formed on an outer surface of the lower end thereof. On the other hand, the step portions 43 are spaced from each other on an inner surface of an outer wall of each of the slider holding portions 42 formed on the both sides of the first housing 4 to receive the spring protrusion 65*a* of the first lock spring 65. Between the step portions 43, a notch 44 is formed to receive a side wall portion 126 which will later be described.

The unlocking mechanism comprises the side wall portion 126. The side wall portion 126 extends from an outer edge of an upper surface of the bottom wall portion 123 formed on each side of the second housing 12. The side wall portion 126 has a cam surface 126*a* formed on its top end. The cam surface 126*a* is engaged with the spring protrusion 65*a* of the first lock spring 65 to displace the spring protrusion 65*a* when the slider 6 slides towards the second connector member 11. Thus, the engagement between the first lock spring 65 and the step portions 43 is released.

The second locking mechanism comprises a second lock spring 45, an engaging recess 121*a*, and the pressing piece 66. The second lock spring 45 is formed in each of the slider holding portions 42 [formed on the both sides of the first housing 4] on its side wall near to the housing body 41. The second lock spring 45 extends in the predetermined direction and has a lower end as a free end. The second lock spring 45 has a locking protrusion 45*a* and a cam protrusion 45*b* formed at its lower end to protrude towards and away from the housing body 41, respectively. A locking recess 121*a* is formed at each longitudinal end of the housing body 121 of the second housing 12 to receive and lock the locking protrusion 45*a* of the second lock spring 45. The pressing piece 66 extends in the predetermined direction from the center of the lower surface of the slider insert portion 62 formed on each side of the slider 6. The pressing piece 66 has a press protrusion 66*a* formed at its lower end at the side of the cam portion 61. The press protrusion 66*a* presses the cam protrusion 45*b* of the second lock spring 45 when the slider 6 slides towards the second connector member 11 and, when the first connector member 3 is completely connected to the second connector member 11, is locked to the lower edge of the cam protrusion 45*b* traversing the cam protrusion 45*b*.

Figure 19:
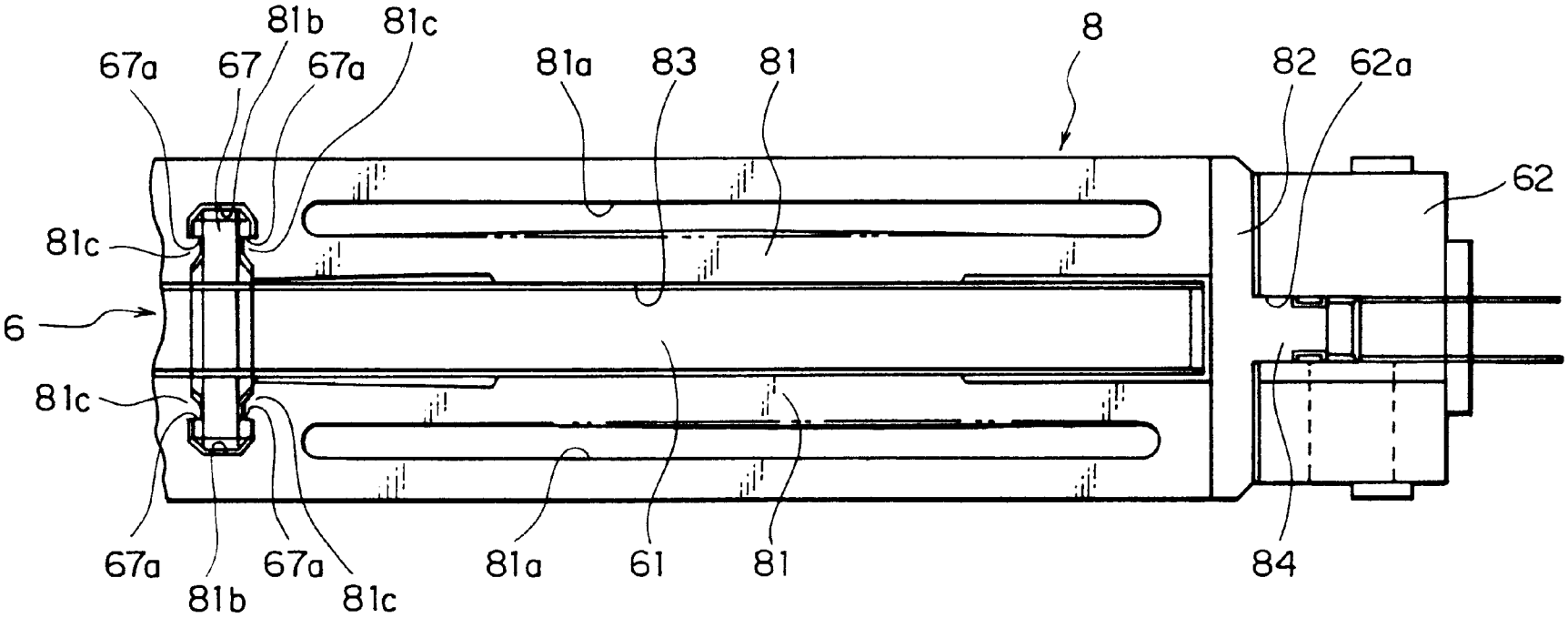
FIG. 19 is an enlarged plan view of a main portion of the first connector member illustrated in FIG. 4.
Figure 20:
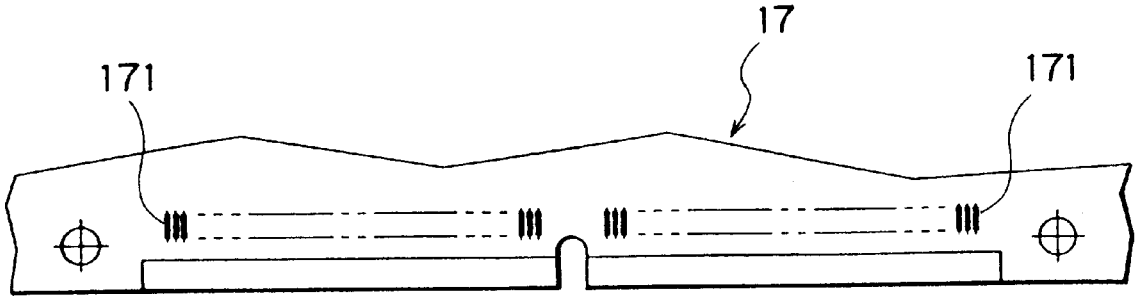
FIG. 20 is a plan view of a main portion of a printed board as an object to which the first connector member in FIG. 4 is attached.
Figure 21:
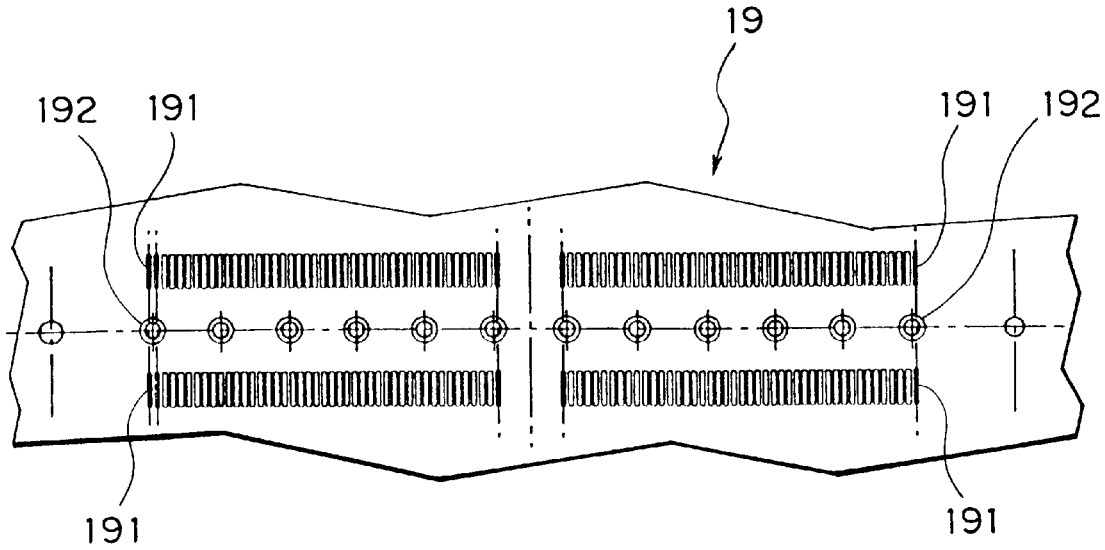
FIG. 21 is a plan view of a main portion of a printed board as an object to which the second connector member in FIG. 4 is attached.

The ZIF connector 1 of this embodiment further comprises the retainer 8 attached to the slider 6 so as to accurately position and reliably fix the FPC 7 with respect to the slider 6 (FIGS. 6 and 19).

The retainer 8 comprises a pair of holding portions 81 and a pair of coupling portions 82 integrally formed. Each holding portion 81 is for elastically pressing the FPC 7 against the shoulder portion 64 of the slider 6 in its thickness direction to fix the FPC 7 to the slider 6. Each holding portion 81 has a generally rod-like shape with two elongated holes 81*a* extending in its longitudinal direction. The elongated holes 81*a* serve to increase the elasticity of the holding portion 81. Each holding portion 81 has a notch 81*b* formed at its center. The notch 81*b* is for insertion of the slider protrusion 67 of the slider 6 which will later be described. The notch 81*b* has a holding protrusion 81*c* formed on its inner surface. Each coupling portion 82 couples the holding portions 81 with a space left therebetween. Between the holding portions 81, a space 83 is formed to receive the upper end of the cam portion 61 of the slider 6 and to insert the FPC 7. Each coupling portion 82 is provided with the retainer protrusion 84. The retainer protrusion 84 is inserted into the groove 62*a* formed in the slider insert portion 62 of the slider 6. By inserting the retainer protrusion 84 into the groove 62*a*, the retainer 8 is located at the predetermined position on the slider 6.

On the other hand, the slider 6 has the slider protrusion 67 formed at the center of its one surface faced to the retainer 8 to extend in the predetermined direction. The slider protrusion 67 has a groove 67*a* formed on its outer surface to extend in the predetermined direction. When the retainer 8 is attached to the slider 6, the groove 67*a* receives the holding protrusion 81*c* formed in the inner surface of the notch 81*b* of the retainer 8 to lock the movement of the holding protrusion 81*c* in the thickness direction of the FPC 7. As a result, the holding portion 81 of the retainer 8 is prevented from being deformed by reaction force produced when the holding portion 81 presses the FPC 7 against the slider 6.

As described above, the elongated hole 76 is formed at the center of the FPC 7 (FIG. 6). By inserting the slider protrusion 67 of the slider 6 into the elongated hole 76, the FPC 7 is automatically positioned with respect to the slider 6.

The FPC 7 is preliminarily inserted through the space 83 of the retainer 8. The connect portion 73 is preliminarily connected to a pad 171 of the first printed board 17. In this state, the retainer 8 is attached to the slider 6. Specifically, the slider protrusion 67 is inserted into the elongated hole 76 of the FPC 7 so that the FPC 7 is automatically positioned with respect to the slider 6. Then, the retainer protrusion 84 of the retainer 8 is inserted into the groove 62*a* of the slider 6. As a consequence, the holding portion 81 of the retainer 8 presses the FPC 7 against the slider 6. Thereafter, the slider 6 is fixed on the first printed board 17 by a bolt (not shown). In this state, the retainer 8 is held by a lower end surface of the first printed board 17 and is therefore prevented from being released from the slider 6. As a result, the FPC 7 is accurately and reliably fixed to the slider 6 by the retainer 8.

Next referring to FIGS. 14 through 18, main operations of the ZIF connector 1 of this embodiment will be described.

In the state illustrated in FIGS. 10 and 14, the slider 6 is located farthest from the first housing 4. At this time, the FPC 7 is downwardly pulled by the first housing 4 and the intermediate portion 74 is forced to return to a flat state. However, the intermediate portion 74 is supported by the shoulder portion 64 of the slider 6 and is therefore kept in the form of the arc greater in curvature.

In order to connect the first connector member 3 to the second connector member 11, the slider 6 is moved from the above-mentioned state towards the second connector member 11 in the predetermined direction together with the first housing 4. In this event, the first housing 4 is brought into contact with the second housing 12. Thereafter, the slider 6 alone moves in the predetermined direction towards the second connector member 11. At this time, the first and the second housings 4 and 12 are not yet coupled.

When the slider 6 alone moves further towards the second connector member 11, the spring protrusion 65*a* of the first lock spring 65 formed on the slider 6 is brought into contact with the step portions 43 formed on the first housing 4. Thereafter, the slider 6 again moves towards the second connector member 11 together with the first housing 4. Since the cam portion 61 of the slider 6 is prevented by the step portions 43 from being engaged with the engaging portion 51*b* of the urging plate 5, the urging plate 5 is located at the predetermined position.

When the slider 6 is moved still further towards the second connector member 11, the first housing 4 is slightly coupled to the second housing 12. At this time, the urging plate 5 is located at the predetermined position. Therefore, the jointed portion 51*a* of the urging plate 5 and the insert portion 72 of the FPC 7 jointed thereto are inserted into the receiving space 124 (FIG. 12) of the second housing 12 without being brought into contact with the contacts 13 and the second ground contacts 14 of the second connector member 11.

Figure 16:
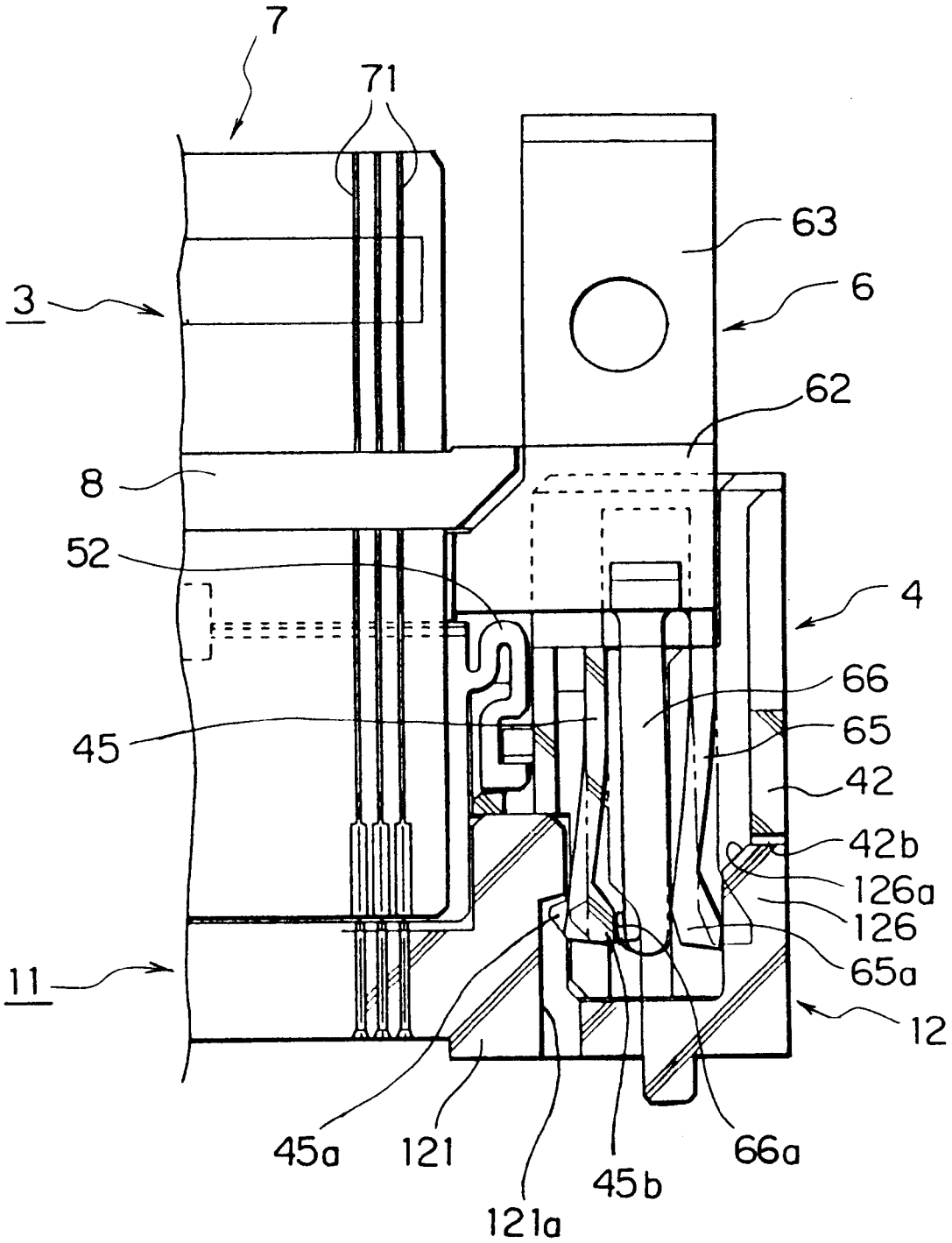
FIG. 16 is an enlarged sectional view for describing the operation of the ZIF connector illustrated in FIG. 4.

When the slider 6 is moved yet further towards the second connector member 11, the first housing 4 is completely coupled to the second housing 12. At this time, the side wall portion 126 formed on the second housing 12 is fitted into the notch 42*b* formed in the first housing 4, as illustrated in FIG. 16. Following this, the cam surface 126*a* of the side wall portion 126 is engaged with the spring protrusion 65*a* of the first lock spring 65 of the slider 6 to move the spring protrusion 65*a* towards the housing body 41. As a result, the engagement between the first lock spring 65 and the step portions 43 is released. Thereafter, the slider 6 alone moves towards the second connector member 11.

Thus, when the slider 6 moves towards the second connector member 11, the cam portion 61 of the slider 6 is engaged with the engaging portion 51*b* of the urging plate 5 to elastically deflect the urging plate 5. As a result, the conductor pattern 71 exposed on the one surface of the insert portion 72 of the FPC 7 jointed to the jointed portion 51*a* of the urging plate 5 is brought into contact with the contact portion 132 of the contact 13 formed in the second connector member 11 to be electrically connected thereto. The other surface of the urging plate 5 is brought into contact with the contact portion 143 of the second ground contact 14 to be electrically connected thereto. At this time, as illustrated in FIG. 16, the cam protrusion 45*b* of the second lock spring 45 formed on the first housing 4 and the pressing protrusion 66*a* of the pressing piece 66 formed on the slider 6 are engaged with each other. The lower end of the second lock spring 45 is pushed towards the housing body 121. The locking protrusion 45*a* of the second lock spring 45 is received in the locking recess 121*a* formed in the housing body 121. As a result, the first housing 4 is locked to the second housing 12.

Figure 17:
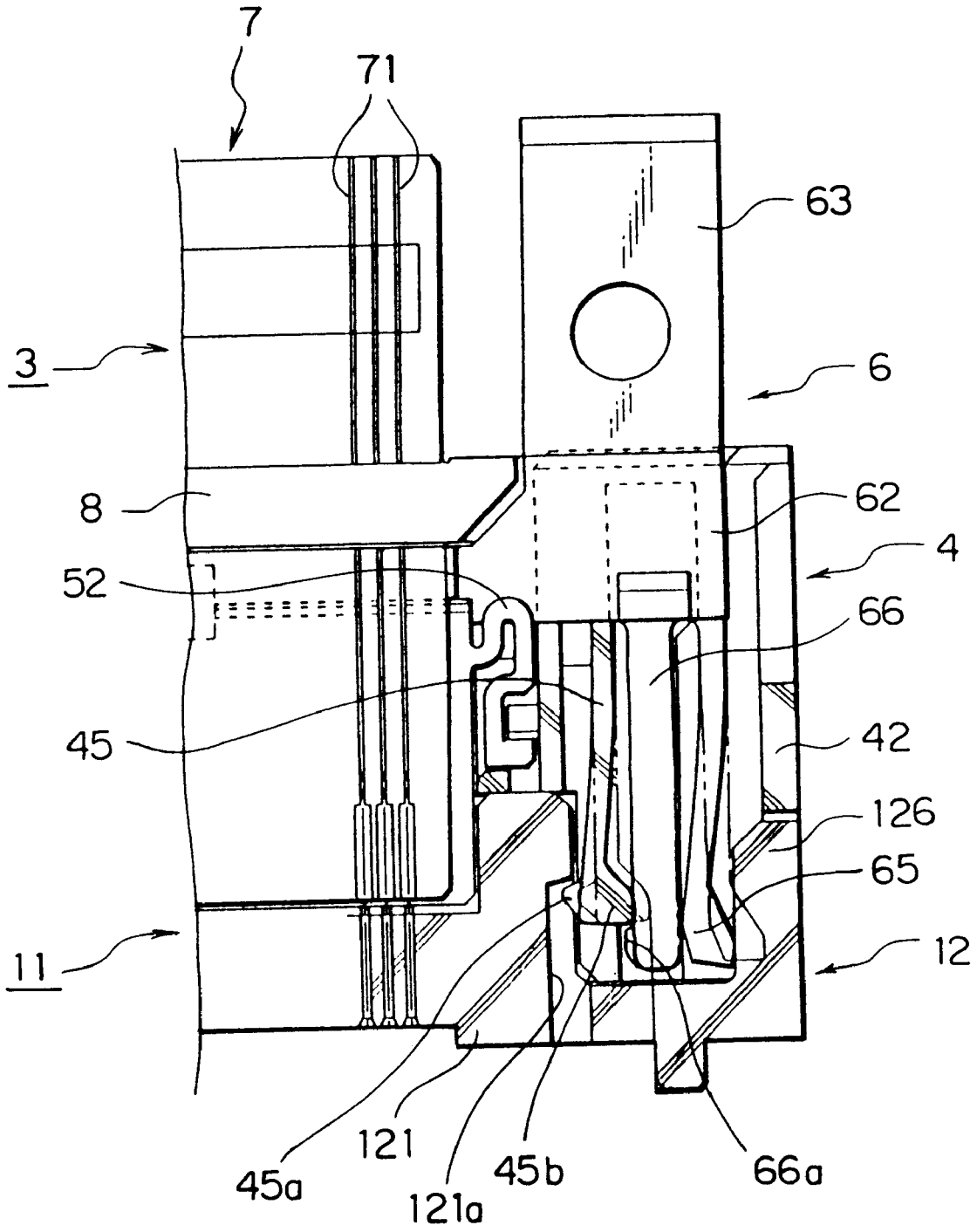
FIG. 17 is an enlarged sectional view for describing the operation of the ZIF connector illustrated in FIG. 4.

When the slider 6 is further moved from the above-mentioned state towards the second connector member 11, the press protrusion 66*a* of the pressing piece 66 formed on the slider 6 traverses the cam protrusion 45*b* of the second lock spring 45 formed on the first housing 4 to be locked to the lower edge of the cam protrusion 45*b*, as illustrated in FIG. 17. As a result, the slider 6 is locked to the first housing 4. In addition, the engagement between the locking protrusion 45*a* of the second lock spring 45 formed on the first housing 4 and the locking recess 121*a* formed in the second housing 12 is kept strong. Therefore, even if the ZIF connector 1 is subjected to external force, the first connector member 3 is prevented from being released from the second connector member 11.

In the above-mentioned state, the arc formed by the intermediate portion 74 of the FPC 7 is kept greater in curvature by the support portion 41*c* formed on the first housing 4 and the pressing portion 53 formed on the urging plate 5. Thus, the arc formed by the intermediate portion 74 of the FPC 7 is continuously kept great in curvature and substantially unchanged in curvature throughout an entire process of connection of the ZIF connector 1. The displacement of the intermediate portion 74 of the FPC 7 is substantially completely inhibited by the shoulder portion 64 of the slider 6, the pressing portion 53 of the urging plate 5, and the support portion 41*c* of the first housing 41. Therefore, the intermediate portion 74 of the FPC 7 and the conductor pattern 71 formed thereon are prevented from being damaged.

Figure 18:
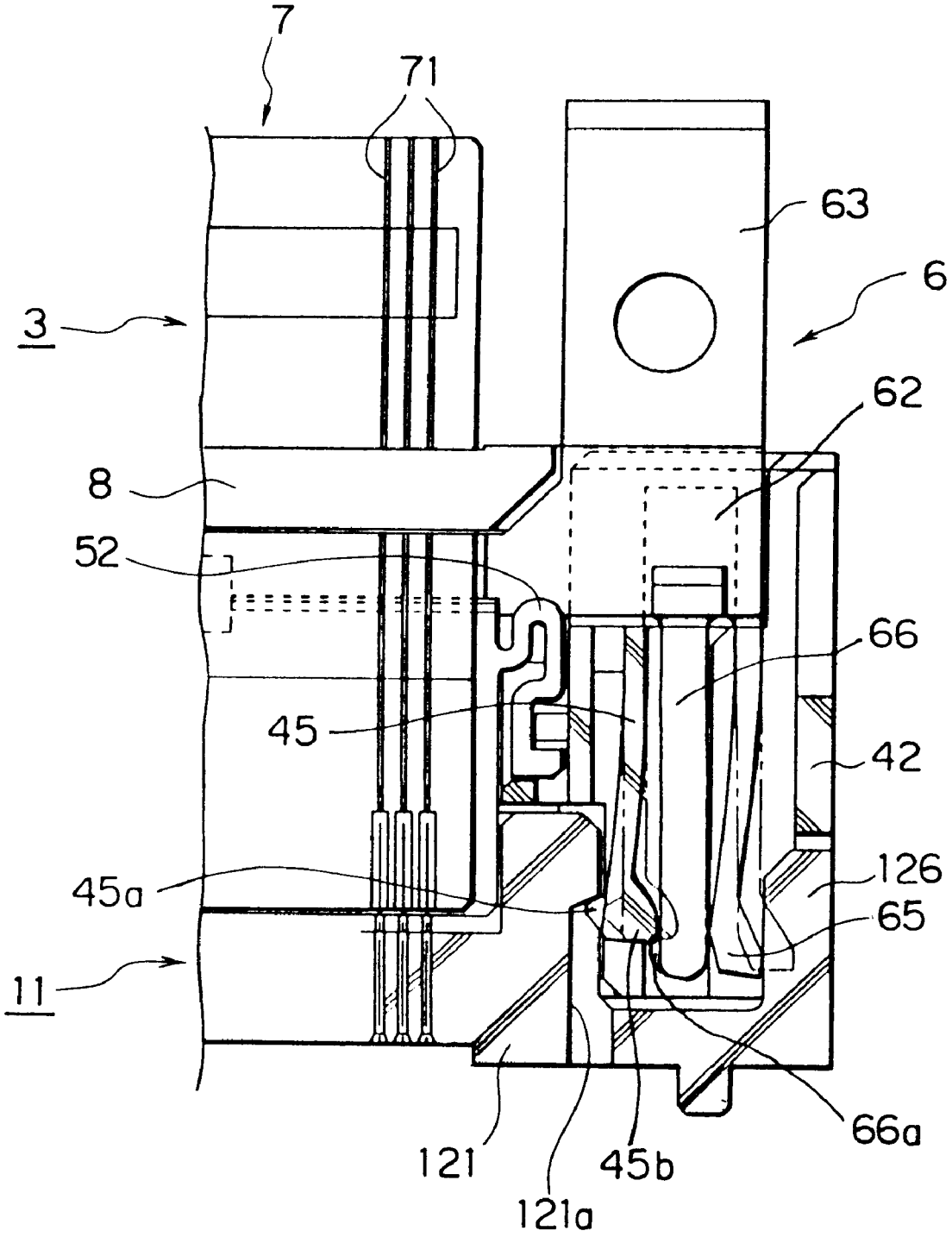
FIG. 18 is an enlarged sectional view for describing the operation of the ZIF connector illustrated in FIG. 4.

On the other hand, in order to release the first connector member 3 from the second connector member 11, the slider 6 is pulled up in the predetermined direction as illustrated in FIG. 18. In order to pull up the slider 6, greater force is required at a first stage in order to make the pressing protrusion 66*a* of the pressing piece 66 formed on the slider 6 traverse the cam protrusion 45*b* of the second lock spring 45 formed on the first housing 4. Once the press protrusion 66*a* of the pressing piece 66 traverses the cam protrusion 45*b* of the second lock spring 45, the slider 6 can be pulled up with little force. When the slider 6 is pulled up, those operations performed upon connection of the first connector member 3 to the second connector member 11 are carried out in a reverse order to release the first connector member 3 from the second connector member 11.

What is claimed is:

1. A ZIF connector comprising a combination of first and second connector members attached to first and second objects to be connected, respectively, wherein:

said first connector member comprises a first housing, an urging plate, a slider, and a flexible contact sheet;

said first housing being adapted to be releasably coupled to said second connector member in a predetermined direction;

said urging plate having a jointed portion to which a part of said flexible contact sheet is jointed, said urging plate being attached to said first housing to be elastically deflectable in its thickness direction and to be elastically returned to a predetermined position;

said slider being adapted to be mounted on said first object and is attached to said first housing to be relatively slidable in said predetermined direction, said slider having a cam portion to be engaged with said urging plate to elastically deflect said urging plate when said slider slides in the first housing towards said second connector member;

said flexible contact sheet comprising an insulator film and a conductor pattern embedded in the insulator film, said flexible contact sheet having an insert portion to be inserted into said second connector member and jointed to said jointed portion of the urging plate, said conductor pattern being exposed on one surface at said insert portion, a connect portion to be electrically connected to said first object, and an intermediate portion between said insert and said connect portions;

said second connector member comprising a second housing and a plurality of contacts;

said second housing being adapted to be attached to said second object and releasably coupled to said first housing in said predetermined direction;

said contacts being disposed in said second housing and comprising terminal portions to be electrically connected to said second object, and contact portions to face, in a substantially untouched condition, said insert portion positioned by said jointed portion of said urging plate located at said predetermined position when said first and said second housings are coupled to each other and to be brought into contact with said conductor pattern when said urging plate is elastically deflected by said cam portion;

said first housing further comprising a support portion having a curved surface for supporting, when said slider slides in said first housing towards said second connector member, an outer surface of said intermediate portion so that said intermediate portion forms a large arc;

said urging plate having a pressing portion for pressing an inner surface of said intermediate portion to make said intermediate portion form the large arc in cooperation with said support portion when said urging plate is elastically deflected by said cam portion;

said slider having a shoulder portion with a curved surface for supporting said inner surface of said intermediate portion to maintain the large arc formed by said intermediate portion when said slider is located farthest from said first housing.

2. A ZIF connector as claimed in claim 1, wherein said flexible contact sheet has a ground pattern formed on the other surface, said urging plate serving as a first ground contact electrically connected to said ground pattern, said second housing including a second ground contact to be brought into electrical contact with said first ground contact.

3. A ZIF connector as claimed in claim 1, wherein said ZIF connector further comprises:

a first locking mechanism formed on said first housing and said slider for locking said slider to said first housing at a position such that said cam portion is not engaged with said urging plate;

an unlocking mechanism formed on said second housing for unlocking said first housing and said slider locked by said first locking mechanism when said first and said second housings are coupled to each other; and a second locking mechanism formed on said first housing, said slider, and said second housing for locking said first and said second housings to each other when said slider slides towards said second connector member while said first and said second housings are coupled to each other, for finally locking said slider to said first housing and maintaining said first and said second housings in a locked state, and for unlocking said slider from said first housing locked by said second locking mechanism by the movement of said slider away from said second connector member.

4. A ZIF connector as claimed in claim 3, wherein said first locking mechanism comprises:

a pair of first lock springs formed on both sides of said slider to extend in said predetermined direction; and a pair of step portions formed on both sides of said first housing to receive one ends of said first lock springs, respectively;

said unlocking mechanism comprising:

a pair of side wall portions formed on both sides of said second housing and having cam surfaces for engaging the one ends of said first lock springs to displace the one ends so that said first lock springs are released from engagement with said step portions;

said second locking mechanism comprising:

a pair of second lock springs formed on the both sides of said first housing to extend in said predetermined direction and having one ends provided with locking protrusions and cam protrusions formed on one and the other surfaces thereof;

a pair of locking recesses formed on the both sides of said second housing to be engaged with said locking protrusions; and a pair of pressing pieces formed on the both sides of said slider to extend in said predetermined direction and having press protrusions formed at one ends thereof to press said cam protrusions and to be locked to edges of said cam protrusions.

5. A ZIF connector as claimed in claim 1, wherein said slider has a retainer attached thereto, said retainer having a holding portion for elastically pressing said flexible contact sheet against said slider in its thickness direction to fix said flexible contact sheet to said slider.

6. A ZIF connector as claimed in claim 5, wherein said slider has a slider protrusion formed on its one surface faced to said retainer to extend in said predetermined direction, said flexible contact sheet having a hole for inserting said slider protrusion to automatically position said flexible contact sheet with respect to said slider.

7. A ZIF connector as claimed in claim 6, wherein said slider protrusion has a groove extending in said predetermined direction, said holding portion having a notch for inserting said slider protrusion, said notch having a holding protrusion formed on an inner surface thereof to be engaged with said groove to prevent deformation of said holding portion.

* * * * *

UNITED STATES PATENT AND TRADEMARK OFFICE

CERTIFICATE OF CORRECTION

PATENT NO. : 5,984,704
DATED : November 16, 1999
INVENTOR(S) : Osamu Hashiguchi

It is certified that error appears in the above-identified patent and that said Letters Patent is hereby corrected as shown below:

Column 1, Line 47, delete "The each" and insert --Each--

Column 5, Line 67, insert --73-- after "portion" (second occurrence);

Column 7, Line 18, insert --body-- after "plate";

Column 9, Line 5, delete "122" and insert --142--;

Column 13, Line 16, delete "first housing" and insert --housing body--;

Column 14, Line 63, delete "ends" and insert --end--.

Signed and Sealed this

Twenty-fourth Day of October, 2000

*Attest:*

Q. TODD DICKINSON

*Attesting Officer*

*Director of Patents and Trademarks*